US005184147A

United States Patent [19]

MacLane et al.

[11] Patent Number: 5,184,147

[45] Date of Patent: Feb. 2, 1993

[54] INK JET PRINT HEAD MAINTENANCE SYSTEM

[75] Inventors: Donald B. MacLane, Portland; Ted E. Deur, Hillsboro, both of Oreg.; Jeffrey J. Anderson, Camas, Wash.; Donald R. Titterington, Tualatin, Oreg.; James C. Oswald, Beaverton, Oreg.; Richard S. Meissner, Portland, Oreg.

[73] Assignee: Tektronix, Inc., Wilsonville, Oreg.

[21] Appl. No.: 688,758

[22] Filed: Apr. 22, 1991

[51] Int. Cl.[5] ..... B41J 2/165

[52] U.S. Cl. ..... 346/1.1

[58] Field of Search ..... 346/140 R, 1.1

[56] References Cited

U.S. PATENT DOCUMENTS

| | | | |
|---|---|---|---|
| 4,015,272 | 3/1977 | Yamamori | 346/140 R |
| 4,417,259 | 11/1983 | Maeda | 346/140 R |
| 4,543,591 | 9/1985 | Terasawa | 346/140 R |
| 4,571,601 | 2/1986 | Teshima | 346/140 R |
| 4,577,203 | 3/1986 | Kawamura | 346/140 R |
| 4,600,931 | 7/1986 | Terasawa | 346/140 R |
| 4,745,414 | 5/1988 | Okamura et al. | 346/140 R |
| 4,800,403 | 1/1989 | Accattino et al. | 346/140 R |
| 4,829,318 | 5/1989 | Racicot | 346/140 R X |
| 4,959,673 | 9/1990 | Noda | 346/140 R |
| 4,970,534 | 11/1990 | Terasawa | 346/140 R |
| 4,970,535 | 11/1990 | Oswald et al. | 346/140 R |

FOREIGN PATENT DOCUMENTS

| | | |
|---|---|---|
| 285155 | 3/1988 | European Pat. Off. . |
| 88310196.6 | 10/1988 | European Pat. Off. . |
| 3611666 | 10/1988 | Fed. Rep. of Germany . |
| 58-173670(a) | 10/1983 | Japan . |
| WO87/04979 | 8/1987 | PCT Int'l Appl. . |
| WO89/04255 | 11/1988 | PCT Int'l Appl. . |
| WO89/03769 | 5/1989 | PCT Int'l Appl. . |

*Primary Examiner*—Joseph W. Hartary

*Attorney, Agent, or Firm*—John D. Winkelman; Mark M. Meininger

[57] ABSTRACT

An ink jet print head cleaning and maintenance system has a purge chamber for applying a vacuum to a nozzle orifice surface. A specialized baffle diverts ink entering the purge chamber away a vent port through which the vacuum is drawn. An elongated wipe engages and wipes the orifice surface and is preferably moved at an extremely slow rate across the surface to enhance the wiping operation. An air knife directs a narrow stream of air across a portion of the nozzle orifice surface with air from the air stream being scanned across the surface for cleaning purposes. A specialized drip edge is positioned beneath the orifice surface for directing drops of ink away from the ink jet print head, the drops of ink being generated during the cleaning procedures. A mechanically simple cam mechanism coupled to a rotatable drum of the printer may be used to shift the maintenance system against the nozzle orifice surface for cleaning purposes.

34 Claims, 15 Drawing Sheets

INK JET PRINT HEAD MAINTENANCE SYSTEM

TECHNICAL FIELD

The present invention relates to ink jet printers and more particularly to systems for cleaning and maintaining the operability of ink jet print heads of such printers.

BACKGROUND OF THE INVENTION

Ink jet printers, and in particular, drop-on-demand ink jet printers having print heads with acoustic drivers for ink drop formation are well known in the art. The principle behind an impulse ink jet of this type is the generation of the pressure wave in an ink chamber and subsequent emission of ink droplets from the ink chamber through a nozzle orifice, the orifice extending through an ink jet print head nozzle orifice surface. A wide variety of acoustic drivers have been employed in ink jet print heads of this type. For example, the drivers may consist of a transducer formed by piezoceramic material bonded to a thin diaphragm. In response to an applied voltage, the diaphragm displaces ink in the ink chamber and causes a pressure wave and a flow of ink to one or more nozzles resulting in the jetting of a drop of ink toward print media. Other types of acoustic drivers for generating pressure waves in ink in response to drive signals include heater-bubble source drivers (so called bubble jets) and electromagnet solenoid drivers.

Known ink jets typically combine an ink jet print head with a reservoir for supplying ink, including plural colors of ink, to various nozzles of the ink jet print head. Also, it is common to shuttle or scan an ink jet print head transversely across print media as the print media is being printed by the ink jet print head.

During printing, drops of ink tend to collect in and around the ink jet nozzle orifices. When the ink does build up, it can prevent drop ejection or cause improper ink drop trajectory and nonuniformity in ink drop size. In one approach to minimizing problems associated with ink build up on a nozzle orifice surface, the surface adjacent to nozzle orifices is coated with an anti-wetting material. In one example, Teflon®, by Dupont Corporation, is used as the anti-wetting material and is deposited on the surface of the nozzle orifice plate as described in co-pending patent application Ser. No. 215,126 and entitled, "Modified Ink Jet Printing Head Method for Producing Ink Jet Printed Images". Even with anti-wetting coatings, the nozzle surface typically must be cleansed of excess ink periodically in order to maintain consistently clean orifices during printing.

In addition to ink build up, contaminants and air bubbles from ink delivered to the nozzle orifices can plug or partially obstruct these orifices, resulting in unsatisfactory printing performance by the printer. Also, air bubbles can be drawn into the nozzle orifices causing their failure. This is a problem in both aqueous inkjet printers and ink jet printers using phase-change or hot-melt ink of the type in which ink is heated and ejected in liquid form from the nozzle orifices and then solidifies on the print media. When hot-melt ink cools in an ink jet print head when the printer is off, the ink tends to contract. Contraction of ink under these conditions can draw air bubbles into the nozzle orifices. Unless eliminated, these air bubbles, as mentioned above, can interfere with or prevent subsequent printing operations. Also, lint, dust and fibers from the environment, including from print media, can travel to the nozzle orifice surface and interfere with ink drop formation, unless cleaned.

A number of prior art approaches for cleaning and maintaining ink jet print heads have previously been disclosed. For example, air bubbles have been purged from an ink reservoir chamber and nozzle orifice plates by accelerating the flow of ink through such components during a purging operation. Such purging is disclosed in U.S. Pat. No. 4,727,378 to Le, et al. and in a service manual for a colorgraphics copier, having Model No. 4692, made by Tektronix, Inc. of Beaverton, Oreg.

U.S Pat. No. 4,800,403 to Accattino, et al. sets forth another approach for cleaning ink jet printing nozzles. As recited in this patent, when an the ink jet print head is moved to a parked position, a container and cover cup is shifted by a complex drive mechanism against a nozzle orifice surface of an ink jet print head. A suction pump is then activated to apply a vacuum to the container and draw ink from the ink jet print head. Simultaneously with the application of the suction, the printing elements are operated to expel ink from the ink jet print head. Following the suction cycle, a valve is opened to vent the interior of the container to atmosphere and permit the removal of the container from the print head. At the end of the purging operation, a resilient disk is rotated to bring a wiping lobe in position to engage the nozzle orifice surface as the print head is moved past the disk.

The complex drive mechanism (as best seen in FIGS. 1 and 2 of this patent) would be relatively expensive and subject to mechanical failure. In addition, this reference is understood to operate by sucking ink through the pump utilized to apply the vacuum. Although this is satisfactory for aqueous inks, phase-change inks would tend to solidify in the tubing and pump, rendering this system inappropriate for such applications.

International Patent Application to Howtek, Inc. (published May 18, 2989 as WO 89/04255) discloses an ink cleaning system in which a seal selectively closes an ink reservoir. Pressurized air is then supplied to the reservoir to force the discharge of ink from nozzle orifices for cleaning purposes. As best seen in FIG. 3, ink is discharged into a gutter assembly, which delivers the ink to a disposable waste container. This system is disclosed as being suitable for cleaning hot-melt ink jet printers. Among the drawbacks of this system is that it does not address problems associated with cleaning a nozzle orifice surface and the degradation in print quality resulting from contamination of the surface surrounding nozzle orifices.

U.S. Pat. No. 4,829,318 to Racicot, et al. discloses a system for purging and cleaning an ink jet print head. During a purging operation, a vent to an ink reservoir is plugged and the reservoir is pressurized to eject ink from nozzle orifices. A ribbon of ink absorbing cloth or fabric is wiped across the surface of a nozzle orifice plate to clean ink from the plate. This patent mentions wiping across the printing face at a rate of 0.13 inch per second and also mentions that the wiping action is initiated at the same time the purge pump is activated. Even though the wiping cloth in this patent is described as lint free, small particles of dust can be transferred from the wiping cloth to the nozzle orifice surface, causing problems in printing.

Devices such as described in the Racicot, et al. patent and the aforesaid Howtek, Inc. International Application suffer from problems in coupling a pressure source to a vent opening. A specialized gasket arrangement is used in the Racicot, et al. patent to address this drawback. In addition, by increasing the pressure of gas, for example air, over ink in an ink reservoir, additional gas may be driven into the ink, which can result in bubbles forming in the ink jet print head after the pressure is relieved.

U.S. Pat. No. 4,577,203 to Kawamura discloses an ink jet recording apparatus in which a suction chamber positioned against a nozzle orifice surface for drawing ink and air out of the ejection nozzles. In addition, a motorized belt having ink scraping projections is operated to scrape dust and other impurities off the nozzle orifice surface. This scraping mechanism and associated motor is mounted to the suction chamber for movement toward and away from the nozzle orifice surface with the movement of the suction chamber. A solenoid is used to move the suction chamber and cleaner. U.S. Pat. No. 4,745,414 to Okamura, et al. is similar to the Kawamura reference in that it has a suction cap and cleaning blade driven by a worm wheel drive. Both of these references are understood (see FIG. 2 of the Kawamura patent and FIG. 4 of the Okamura, et al. patent) to deliver ink sucked from a nozzle orifice surface by way of tubing to a pump. In the case of hot-melt ink, ink can solidify in such cleaning elements and cause them to fail. These devices also suffer from other drawbacks.

U.S. Pat. No. 4,970,535 to Oswald, et al. describes an ink jet print head face cleaner in which air is directed substantially across the entire nozzle surface of an ink jet print head for cleaning purposes. This air is passed through a chamber which is sealed against a nozzle orifice plate during the air cleaning operation. When this chamber is removed, ink remaining on the orifice surface would not be satisfactorily cleaned by the air. Also, by directing an air stream across substantially an entire surface of a nozzle orifice plate, the cleaning effect of the air stream is diluted, as opposed to being concentrated for more effective cleaning.

Therefore, a need exists for an improved ink jet print head maintenance system directed toward overcoming these and other disadvantages of the prior art.

SUMMARY OF THE INVENTION

The present invention is an ink jet print head cleaning or maintenance system and method for ink jet printers of the type having an ink jet print head with a nozzle orifice surface containing at least one orifice through which ink drops are ejected in response to drive signals applied to an ink drop driver. Ink is supplied to the ink jet print head and orifices from an ink reservoir.

In accordance with one aspect of the invention, a purge chamber has an ink receiving opening and is selectively shifted from a first position spaced from the ink jet nozzle orifice surface to a purge position with the ink receiving opening oriented to receive ink ejected from the ink jet print head orifice. The purge chamber has a vacuum port spaced from the ink receiving opening and a baffle positioned within the interior of the purge chamber between the ink jet nozzle orifice surface and the vacuum port such that ink entering the purge chamber impinges on the baffle and does not pass directly to the vacuum port when a vacuum is drawn at the vacuum port. Consequently, the passage of ink into the vacuum port is minimized and more specifically is virtually eliminated. This is particularly advantages when hot-melt inks are used which could solidify in tubing and a vacuum pump coupled to the vacuum port and cause a failure of these components unless, at additional expense and complexity, a heating system is included for these components.

The baffle may be positioned upright within the purge chamber. The baffle may also have a lower edge margin with drop concentrating projections which direct ink flowing down the baffle away from openings in the baffle, and thus away from the vacuum port.

A dam may be provided across a lower portion of the ink receiving opening with one or more preferably plural spillway outlets. The dam and spillway outlets retard the outward flow of ink from the interior of the purge chamber when the purge chamber is shifted from the purge position to the first position spaced form the nozzle orifice surface. As a result, the amount of ink remaining on the nozzle surface following the purge operation is minimized. The spillways are preferably arranged as narrow slits which concentrate ink flowing from the purge chamber into respective narrow streams associated with each slit. The dam may have an upper edge surface which is sloped downwardly toward the interior of the purge chamber to further guide ink removed during the purge operation away from the nozzle orifice surface. At least a portion of the lower edge margin of the baffle may extend below the upper edge surface of the dam to direct ink flowing down the baffle surface to the lower region of the purge chamber behind the dam. In a purge operation, the ink jet drivers are typically operated in conjunction with the application of a vacuum to provide an increased mass flow of ink to facilitate the removal of bubbles and debris from nozzle orifices of the ink jet print head. The baffle and dam may be formed integrally with a gasket which surrounds the ink receiving opening.

As another aspect of the present invention, a downwardly inclined drip collector may be positioned below the ink receiving opening. The drip collector and has an upper collection surface which receives ink from the purge chamber when the purge chamber is in the first position. Ink reaching the ink collection surface flows downwardly to a receptacle. In a hot-melt ink cleaning system, the purge chamber and drip collector are typically heated to melt the ink and cause it to flow as a liquid to the ink receptacle.

As a further aspect of the present invention, an air knife is positioned to direct air downwardly in an air stream across only a portion of the ink jet nozzle surface. The nozzle surface and air knife are moved relative to one another so that the air knife incrementally sweeps the entire nozzle orifice surface during an air cleaning cycle. In a conventional ink jet printer, ink jet print heads are typically shuttled or moved in a reciprocating manner during application of ink to print media, such as print media supported on a drum. The drive mechanism used to move the ink jet print head for printing purposes may also be used to move the nozzle orifice surface past the air knife for cleaning purposes.

As a further aspect of the invention, the ink jet print head includes a print head drip edge projecting downwardly below the ink jet nozzle orifice surface. Ink is swept from the print head drip edge by the air knife. The print head drip edge directs ink away from the ink jet print head so that it does not accumulate thereon and assists in concentrating the ink into drops for easier removal. The print head drip edge may have downwardly projecting ink drop concentrating projections such as serrations which cause the ink to form drops along the drip edge which may more easily be removed. It has also been found that the inclusion of plural perforations in the print head drip edge encourages ink drops that form on the drip edge to more readily fall from the edge. The ink collector may be positioned below the air knife such that ink drops removed from the drip edge by the air knife are collected and delivered to the receptacle.

As a still further aspect of the present invention, a wipe with an elongated wipe surface is supported for selective engagement of the wipe surface with the nozzle orifice surface to wipe ink from the ink jet nozzle orifice surface. It has been found that moving the wipe relative to the nozzle orifice surface at a very slow speed, for example no greater than about 1.5 mm/second, substantially eliminates the formation of minute ink drops on the ink jet nozzle orifice surface behind the trailing edge of the wipe. These minute ink drops, if left behind on the nozzle orifice surface, can interfere with ink jet print head performance and may cause the degradation of protective coatings on the nozzle orifice surface. This wipe is typically mounted to the purge chamber. In a hot-melt ink cleaning system, heat from the purge chamber also heats the wipe so that solidified ink does not tend to accumulate on the wipe.

As another aspect of the present invention, a simplified drive mechanism is used to operate the cleaning and maintenance system. In particular, in ink jet printers having a drum which is rotated during the printing operation, a cam may be mounted to the drum and configured to shift the purge chamber between first nonpurge and purge positions in response to rotation of the drum. Therefore, complex drive mechanisms for the ink jet cleaning system are eliminated.

In cleaning or maintaining an ink jet print head in accordance with the present invention, a purge cycle is accomplished by selectively applying a pressure differential across nozzle orifices, as by applying vacuum to the ink jet print head, while jetting ink from the ink jet print head during purging. In addition, an air cleaning cycle is accomplished by directing air across the ink jet nozzle orifice surface. Furthermore, a wipe cycle is accomplished by wiping the ink jet nozzle orifice surface with a wipe surface. These steps may be performed in sequence followed by a repetition of the air cleaning cycle to further remove ink on the ink jet nozzle orifice surface after the wiping step. The wiping and air cleaning steps may be performed periodically without also performing a purge cycle, such as following each occurrence of printing of a predetermined number of prints. In addition, multiple purge cycles may be completed with the duration of the purge cycle being varied, for example increased, with a successive repetition of the purge cycle.

The present invention relates to the above unique combination of aspects as well as to individual aspects as set forth in the claims.

It is accordingly an overall object of the present invention to provide an improved ink jet print head cleaning or maintenance system and method.

These and other objects, features and advantages of the present invention will become apparent with reference to the following drawings and detailed description.

DETAILED DESCRIPTION OF A PREFERRED EMBODIMENT

Figure 1:
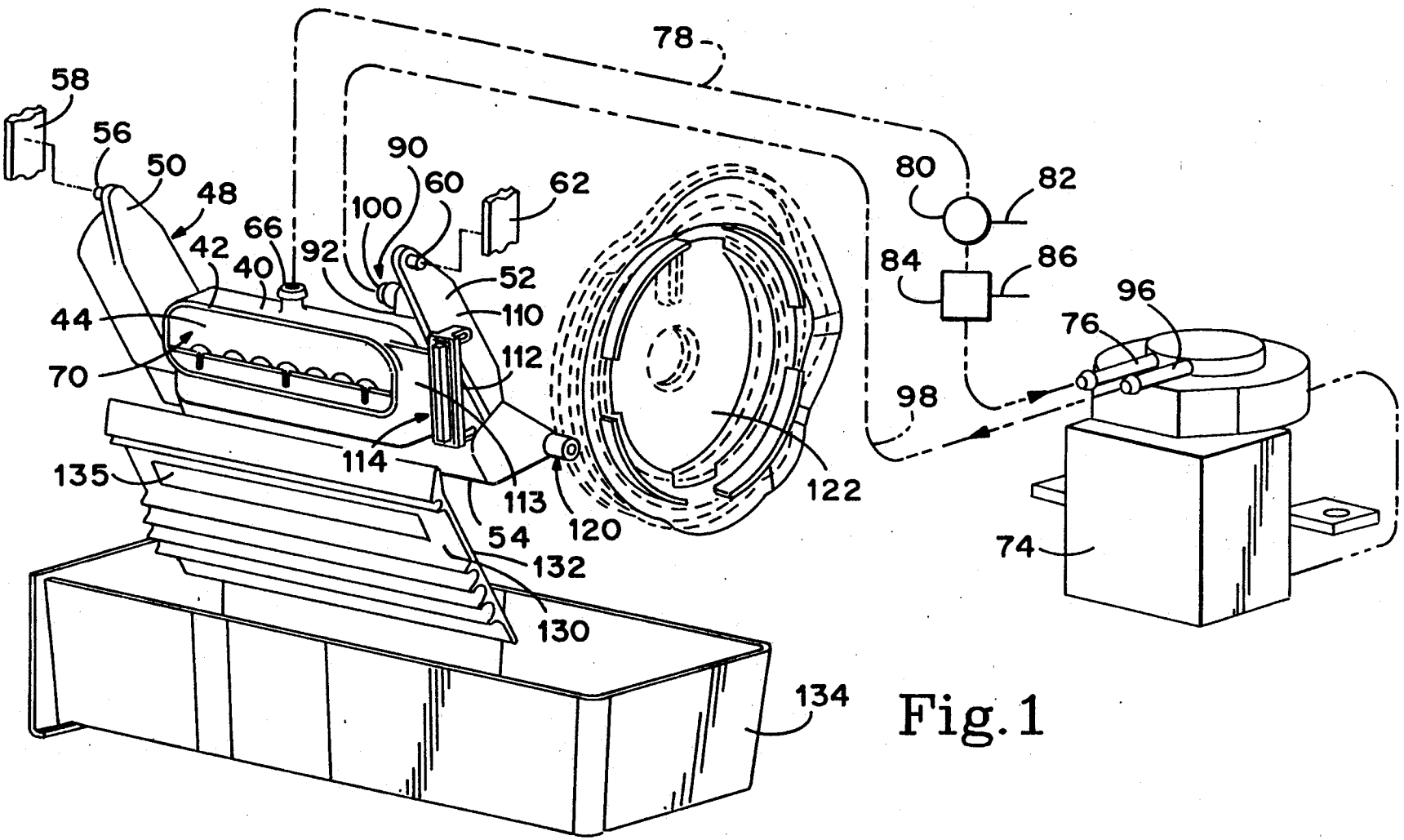
FIG. 1 is partially schematic perspective view of an ink jet cleaning or maintenance system in accordance with the present invention.
Figure 2:
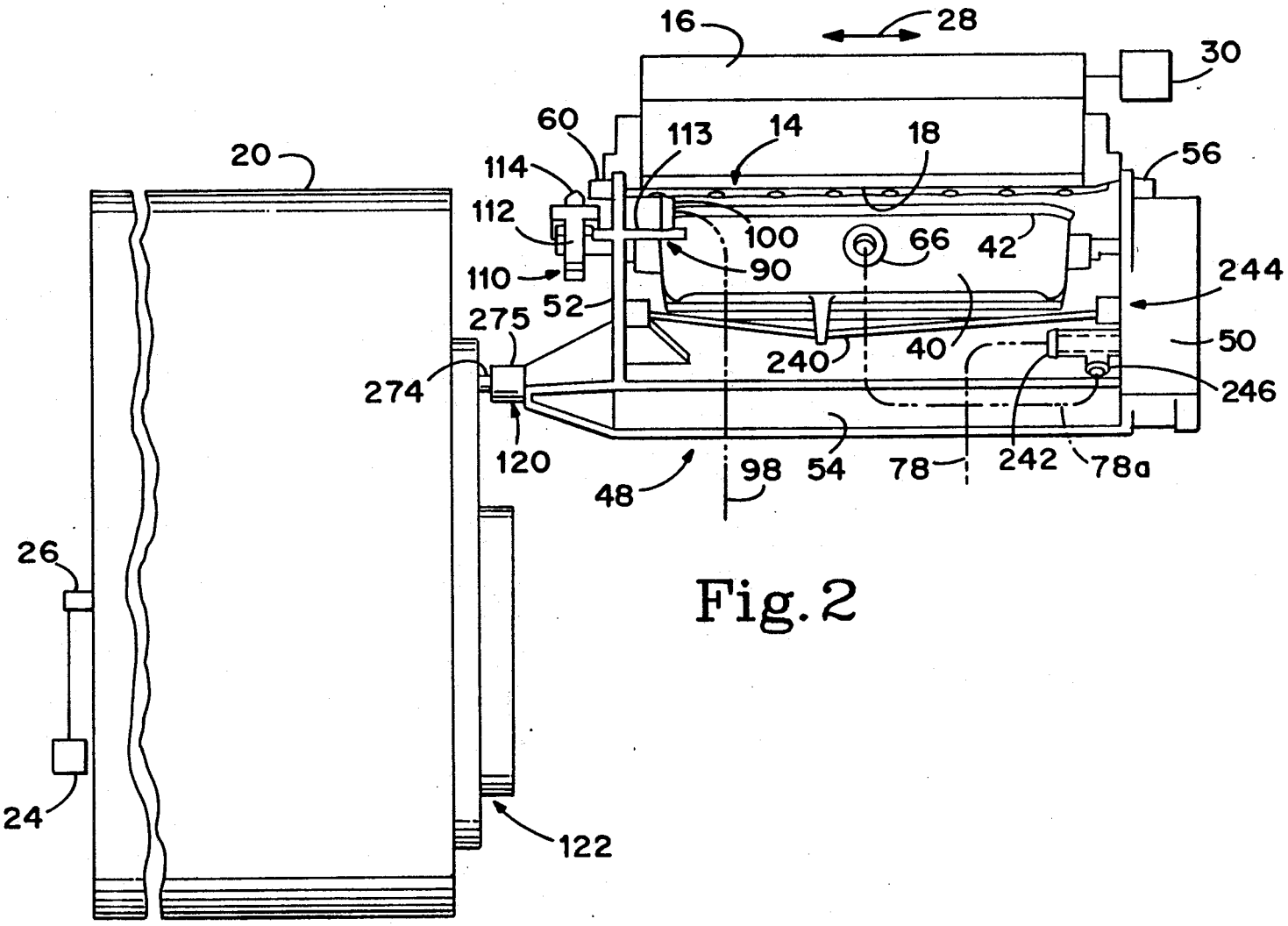
FIG. 2 is top plan view of the invention of FIG. 1 illustrating a cam drive mechanism mounted to a print media supporting drum which may be used to operate the maintenance or cleaning system and also illustrating an ink jet print head in position for initiating a cleaning operation.

Referring to FIGS. 1 and 2, a printer has an ink jet print head 14 mounted to an ink containing reservoir system 16 which supplies ink to the ink jet print head. The ink jet print head includes an ink jet nozzle orifice surface 18 through which at least one, and preferably plural orifices (such as indicated at 18 in FIG. 8), from which ink drops are ejected toward ink drop receiving print media. Print media may, for example, be carried on a drum 20 (FIG. 2) which is rotated in either direction by a motor drive system 24 drivenly coupled to a shaft 26 of the drum. The motor drive system may take any convenient form and may include a stepper motor coupled by one or more timing belt sprockets and a timing belt to the drum shaft 26. Alternatively, print media, which may be in roll form, is simply transported past a platen instead without using a drum. In a conventional manner, the ink jet print head 14 and reservoir 16 may be shuttled or reciprocated, as indicated by arrow 28, transversely back and forth to scan and print the print media carried by the drum 20. A drive mechanism is indicated schematically at 30 for shuttling the ink jet print head and reservoir.

Mechanisms for transporting print media, such as drums, as well as shuttling ink jet print heads are well known in the art. One exemplary drop-on-demand ink jet print head is described in U.S. Pat. No. 4,727,378 to Le, et al., which is incorporated herein by reference. Another such ink jet print head is disclosed in U.S. patent application Ser. No. 07/430,213 to Roy, et al., now U.S. Pat. No. 5,087,930, and incorporated herein by reference. Each of these ink jet print heads utilizes acoustic drivers, and more specifically piezoceramic material, for generating a pressure wave in the ink jet print head in response to drive signals. These pressure waves cause the ejection of ink drops from associated nozzle orifice openings on demand. Addressabilities of 300 dots/inch or more can be achieved using ink jet print heads of this type. Also, these ink jet print heads may be utilized for ejecting drops of hot-melt or phase-change ink toward print media, as well as for non-hot-melt ink, such as aqueous ink. In the case of hot-melt ink printers, heaters are included to heat the ink reservoir and ink jet print head to maintain the ink in a liquid state for jetting purposes.

Figure 12:
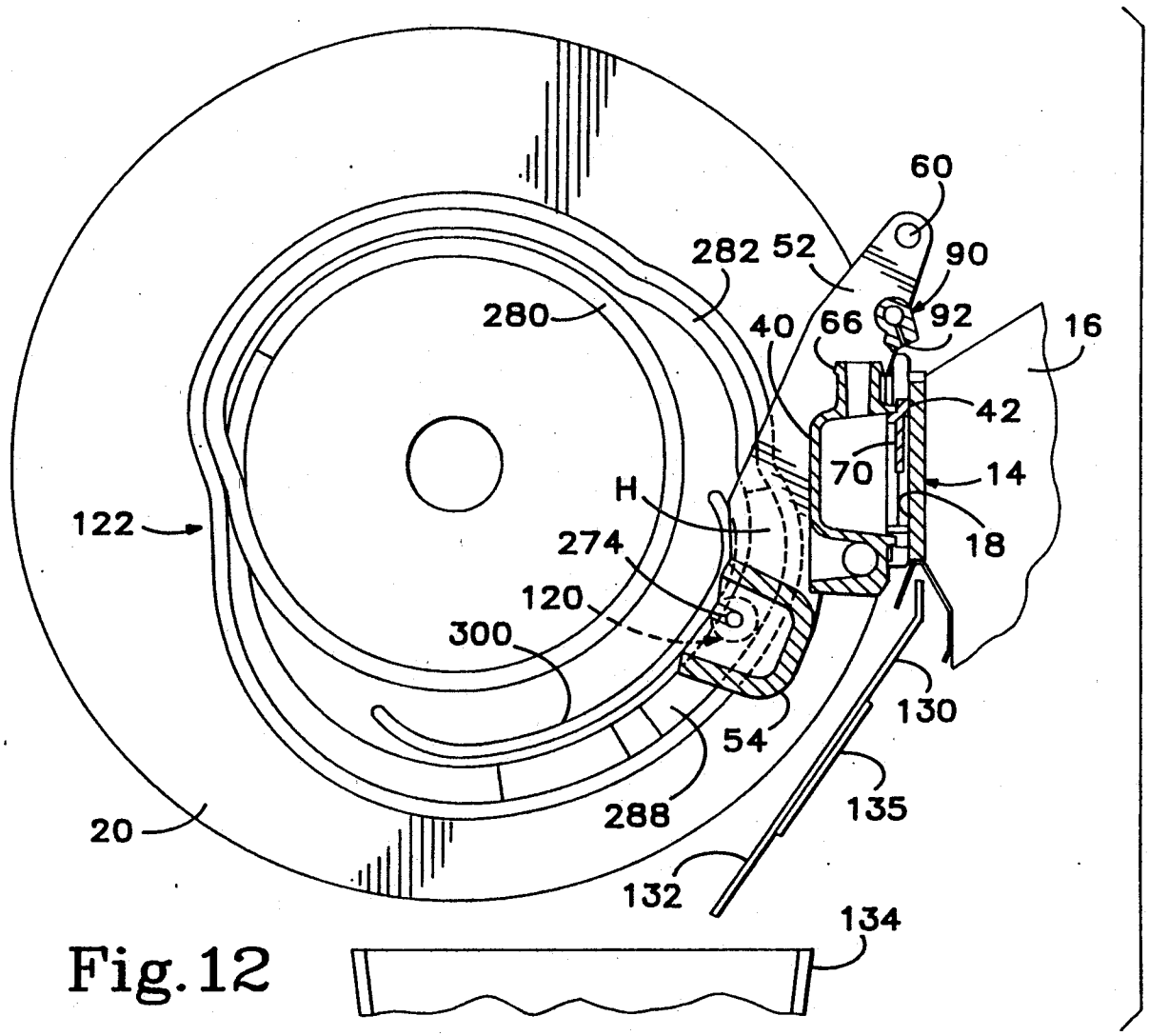

FIG. 1 illustrates a preferred form of ink jet print head cleaning or maintenance system for cleaning an ink jet print head. As shown in this figure, the system includes a purge chamber 40 having a hollow interior. The purge chamber 40 has an ink jet print head engaging surface 42 surrounding an ink receiving opening 44 which communicates with the interior of the purge chamber. The purge chamber is supported for selectively shifting the ink jet print head engaging surface 42 from a first position spaced from the ink jet nozzle orifice surface 18, as shown in FIG. 2, to a purge position against the ink jet nozzle orifice surface, such as described in detail below in connection with FIG. 12. The purge chamber 40 is coupled to a purge chamber support, one form of which is indicated at 48 and described below in greater detail in connection with FIG. 13. In general, the support 48 includes a pair of upright legs 50, 52 projecting generally upwardly from a cross piece or base 54 so as to form a generally U-shaped support with the purge chamber 40 mounted between the legs 50, 52. The legs, and thus the support 48, are pivotally coupled to the printer framework. For example, the leg 50 includes a pivot pin 56 for pivotal connection to support framework 58 of the printer. Similarly, the leg 52 includes a pivot pin 60 for pivoting to a portion of the printer framework indicated at 62. The pins 56 and 60 are positioned generally along a horizontal pivot axis such that purge chamber 40 may pivot about this axis toward and away from the ink jet nozzle orifice surface 18 (FIG. 2).

Figure 4:
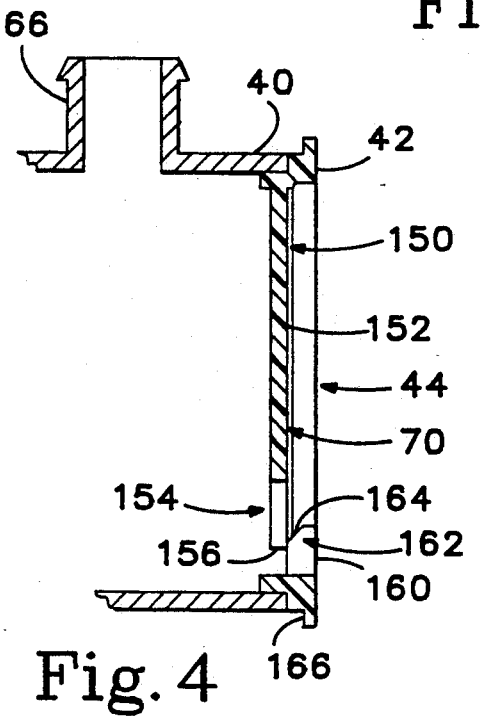
FIG. 4 is a vertical cross-sectional view taken along lines 4—4 of FIG. 3 illustrating the mounting of the gasket to the purge chamber.

The purge chamber has a vacuum port 66 spaced from the ink receiving opening 44 (see both FIGS. 1 and 4). A baffle 70 is positioned within the purge chamber between the ink jet nozzle orifice surface 18 and the vacuum port 66 such that ink entering the purge chamber impinges on the baffle and is directed by the baffle away from the vacuum port so that it does not pass directly into the vacuum port. A pump 74 (FIG. 1) has a suction line 76 coupled by a conduit 78, such as flexible tubing, to the vacuum port 66. When a valve 80 is open, for example in response to a control signal on line 82 to a solenoid operable to open and close the valve 80, the suction line 76 is coupled to the port 66 for purposes of drawing a vacuum in the purge chamber. A typical vacuum drawn on the purge chamber ranges from about 5 psi to about 11 psi. With this construction, the passage of ink to the conduit 78 and pump 74 is virtually eliminated, an important advantage when this system is utilized in conjunction with hot-melt ink jet printer. That is, hot-melt ink does not become solidified in the vacuum system and conduits where it can disable this system. Although heaters could alternatively be used in the line 78 and in the pump to maintain the ink in liquid form, this would involve added expense. As an optional feature, an ink accumulator filter 84 may be included in the line 78 for capturing any small quantities or particulars of ink which inadvertently pass through the vacuum port toward the pump. One suitable accumulator is a filter of the type used in the fuel lines of gasoline powered automobiles. A small bleed aperture 86 may be included in the accumulator to permit the bleeding of the vacuum line 78 in the event power to the pump is shut off while a vacuum is being drawn on the ink jet print head nozzle orifice surface 18. For example, a 0.013 inch size aperture may be included for this purpose, this aperture being small enough to permit the application of a vacuum to the purge chamber while still bleeding off the vacuum in the event of a power failure.

The maintenance system of FIG. 1 also includes an air knife 90 having an air pressure orifice outlet 92 which is oriented to direct air across a portion of the nozzle orifice surface 18 during an air cleaning cycle as described below.

In general, as the nozzle orifice surface is moved relative to the air nozzle 92, such as by shuttling the ink jet print head in the direction of arrow 28, air is directed downwardly across a narrow region or band of the orifice surface. The air stream from the air knife incrementally cleans a portion of the orifice surface as the surface moves passed the air nozzle. Because a relatively narrow air stream may be used, for example approximately ten mm wide, relatively high air pressures can be achieved without requiring a movement of a massive volume of air. Typical air flow rates at nozzle 92, for an air nozzle diameter of 0.04 inch, range from about 11 to about 15 SCFH. Although a separate source of pressurized air may be utilized to supply air to the air knife, the same pump 74 may be used to supply this air as is used to draw the vacuum at the purge chamber. In this case, the pressure output line 96 from pump 74 is coupled by a conduit, such as tubing 98, to an inlet 100 to the air knife 90. With this arrangement, the importance of eliminating the passage of ink to the pump becomes more important as otherwise this ink could be directed through the pump and conduit 98 to the air knife, thereby clogging the air knife nozzle and also reaching the nozzle orifice surface which is being cleaned. The optional accumulator filter 84 also minimizes this possibility.

In accordance with the illustrated embodiment of the present invention, a wipe mechanism 110 is provided for engaging and wiping the nozzle orifice surface 18 as part of the cleaning and maintenance procedure. As shown in FIG. 1, the wipe mechanism 110 includes a mount 112 coupled by a bracket or flange 113 to the purge chamber 40. The mount 112 supports an elongated wipe 114 which is moved into engagement with the nozzle orifice surface 18 at suitable times. As the nozzle orifice surface is moved relative to the wipe, such as by slowly shuttling the ink jet print head in at least one direction, the wipe removes residual ink on the nozzle orifice surface 18. The operation of the wipe is described in greater detail below.

The purge chamber, wipe and air knife may be separately supported with respective mechanisms for positioning these components relative to the nozzle orifice surface for cleaning purposes as required. However, a compact system is provided by supporting each of these elements from the common support 48. It is possible to use a separate drive mechanism for shifting the support 48 and the ink jet print head maintenance components, for example the purge chamber, in position for performing the cleaning and maintenance operations. However, it is preferred that these components be operated utilizing an existing drive mechanism found in a printer, such as the drive mechanism used to rotate a drum of the printer. Also, rather than relatively complex gearing mechanisms, a mechanically simple cam and cam follower design is preferred. As shown in FIGS. 1 and 2, a cam 122 may be mounted to the drum 20 for engagement by a cam follower mechanism 120 which projects toward the drum from a lower region of the support 48, and more specifically which projects outwardly from one end of the base 54. The operation of this cam and cam follower mechanism is described in connection with FIGS. 11–12 and 14–17 below.

An ink collector, illustrated in FIG. 1 as a plate 130 having an inclined upper ink collection surface 132, is positioned below the purge chamber 40. Consequently, ink exiting from the purge chamber following a purge operation flows downwardly onto the surface 132. An ink receptacle 134 is positioned below the ink collector for receiving ink flowing from the surface 132 and into the receptacle. In the case of hot-melt ink, a heater, indicated at 135 may be mounted to the collector 130 for purposes of heating the collector. Recesses in the collector 130 may also be used to support a conventional cartridge heater. This maintains the hot-melt in a liquid state so that it flows downwardly into the receptacle 34. The heater 135 may be operated at all times during a cleaning operation or intermittently operated to prevent a build up of solidified ink on the ink collector surface 132. A similar heater, not shown in FIG. 1, may be utilized to heat the purge chamber 40 to prevent the solidification of hot-melt ink within this chamber. In a hot-melt ink application, the purge chamber 40 and collector 130 are typically of a heat conductive material, such as aluminum. Also, the bracket 113 and mount 112 may be of a thermally conductive material, such as aluminum, and in this case would conduct heat from the purge chamber to the wipe 114 to assist in melting hot-melt ink from the wipe so that it does not accumulate thereon. However, inasmuch as the nozzle orifice is heated in an ink jet printer of the phase-change ink type, the heat from the nozzle orifice surface is available in addition to, or in lieu of, heat from another source for cleaning the wipe. With the vertical orientation of the wipe 114 as shown in FIG. 1, gravity also assists in causing ink to flow from the wipe and away from the sensitive nozzle orifice containing areas of an ink jet print head, which are typically engaged by a central portion of the wipe.

Figure 3:
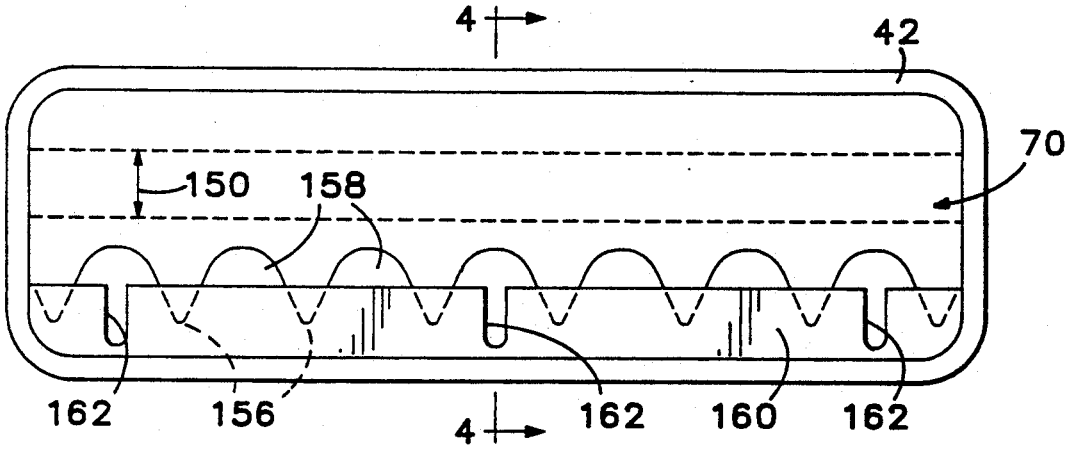
FIG. 3 is a front elevational view of a combined baffle and gasket utilized in intercepting the flow of ink from the ink jet print head to a vacuum port during a purge cycle.

A preferred form of the baffle 70 is illustrated in FIGS. 3 and 4. In general, in this form the baffle 70 is upright and has a solid or non-perforated target region aligned with an upper region of the ink receiving opening 44, such as illustrated schematically at 150 between a pair of spaced apart dashed horizontal lines in FIG. 3. This target region is positioned adjacent to the orifices of the nozzle orifice surface 18 when the purge chamber is shifted to its purge position in engagement with the nozzle orifice surface. When in this position, ink jetted from the nozzle orifices impinges the baffle 70 at the target area 150, rather than passing to the vacuum port 66. The impinging ink flows downwardly along the front surface 152 of the baffle 70. Ink flows as a sheet downwardly along the surface 152 without falling free from the surface.

The lower edge margin 154 of the baffle 70 includes plural drop concentrating projections, some being indicated at 156 in FIG. 3. These projections 156 are separated by baffle openings, some being indicated at 158 in FIG. 3. The openings 158 provide a path through which a vacuum may be drawn from the port 66 and at the nozzle orifice surface. In general, the openings 158 are configured and sized so that ink flowing downwardly along the baffle follows the boundary of the openings to the drop collection projections 156, as opposed to forming a film across the opening. If a film were formed, ink could be drawn more readily into the vacuum port when this film broken during the application of a vacuum to the purge chamber. The shape and size of the openings may be varied. However, with the openings generally semi-circular at their upper regions and sized to be approximately one-half inch in diameter at such upper regions, ink follows the portions of the baffle bounding the openings without passing or falling through the opening where the ink could be drawn into the vacuum port. The projections 156 direct the passing ink into a lower region of the purge chamber.

As also shown in FIGS. 3 and 4, a dam 160 may be provided and extends transversely across a lower region of the ink receiving opening. The illustrated dam 160 has one or more, and in this case three, relatively narrow spillways indicated at 162 in FIG. 3. These spillways provide outlets through which ink held within the interior of the purge chamber 40 behind the dam exits from the purge chamber after the purge chamber is shifted to a position spaced from an ink nozzle orifice surface following a purge cycle. The dam 160 maintains the ink collected during a purge cycle away from the ink jet nozzle orifice surface 18 except where the spillways are located. As the purge chamber is withdrawn from the ink jet nozzle orifice surface 18, the flow of ink is retarded, inasmuch as it is confined to the spillways. Therefore, ink from the purge chamber does not wet any significant portion of the nozzle orifice surface. As a specific example, for a nozzle orifice surface which is 3.9 inches long by 1.2 inches wide, the spillways are typically only about 0.2 inch high and 0.15 inch wide. As a result, residual ink on the nozzle orifice surface remaining following a purge operation is minimized so that further cleaning of ink from the nozzle orifice surface can be more readily accomplished.

In addition, the dam preferably has an upper edge surface which is sloped downwardly, as indicated at 164, away from the ink receiving opening and toward the lower region of the purge chamber. This configuration aids in directing ink that happens to contact the upper edge surface of the dam away from the ink jet nozzle orifice surface 18. Furthermore, as best seen in FIGS. 3 and 4, the drip collecting projections 156 are positioned below the upper edge of the dam so that ink is guided behind the dam by the baffle 70. In the FIGS. 3 and 4 forms of the invention, the baffle 70 and dam 160 are formed integrally as a gasket which also comprises the rim 42 which engages the nozzle orifice surface when the purge chamber is in the purge position. As shown in FIG. 4, the gasket includes a lower lip 166 which assists in preventing ink from flowing to the underside of the purge chamber from the spillways or slits 162. That is, ink flows in a narrow stream through the slits 162 and downwardly across the gasket and lip 166 to the ink collector 130 (FIG. 1). The gasket and baffle may be of any suitable material, but for gasketing purposes a resilient material is preferred, such as a 60 Shore A durometer fluorinated silicon rubber.

Figure 6:
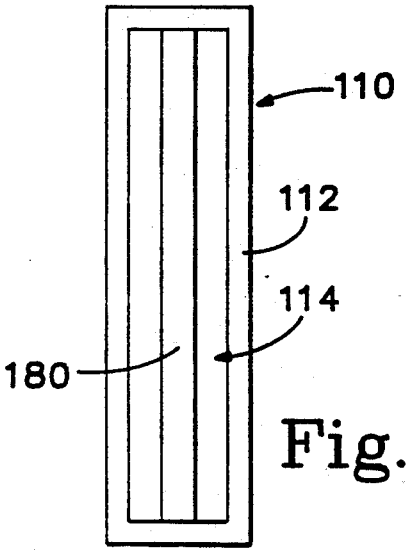
FIG. 6 is a front elevational view of the wipe of FIG. 5.
Figure 7:
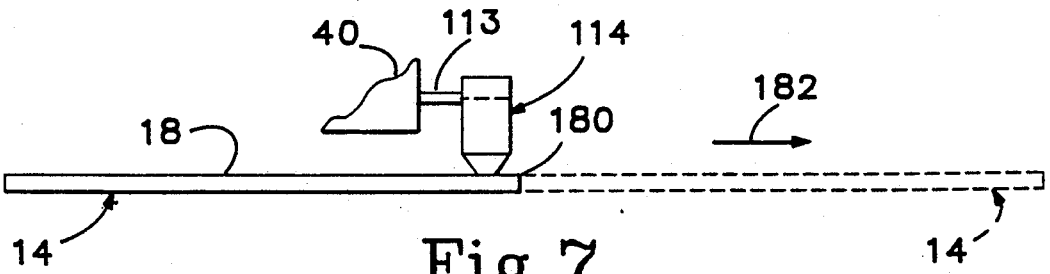
FIG. 7 is a top view schematic illustration of a wipe cycle in accordance with the present invention.

The wiper 114 and its operation will be described in connection with FIGS. 5–7. Ink jet print heads have a number of potential failure modes that reduce print quality. First, during normal operation, a paper fiber or other particle may land on an ink jet print head nozzle surface in a way that interferes with printing. This is a random problem inherent to ink jet printing and in particular when paper is used as the print media. Also, the ink jet print head nozzle orifice surface may become wetted with ink and cause nonuniform drop ejection and the mixing of ink colors, especially where nozzle orifices are closely spaced and wherein adjacent nozzle orifices eject drops of a different color. As previously mentioned, to control wetting, the ink jet nozzle orifice surface may be coated with a thin layer of Teflon TM or other coating material as an anti-wetting agent. When the coating is in good condition, ink on the nozzle orifice surface beads up and away from the orifices and the ink meniscus at each orifice remains confined by the orifice geometry. The confined meniscus results in predictable and consistent drop formation and ejection velocity. However, under normal printing conditions, the anti-wetting properties of coatings may degrade. With this degradation, ink forms an irregular film emanating from the orifices. The menisci are then defined by the irregular boundary of the film rather than the predictable and uniform boundaries of the orifices. Under these conditions, drop formation and ejection may no longer be uniform and copy quality is reduced. In addition, a film adjacent to orifices is an effective pathway for mixing ink of different colors from adjacent orifices. This mixed ink would show up as incorrectly colored pixels in resulting prints.

Wiping of the orifice surface with a wiper blade 114 is effective at removing particles that interfere with printing. Also, it has been discovered that periodic wiping of the orifice surface is effective at preserving anti-wetting properties of coatings, such as Teflon TM coatings, thereby resulting in more uniform drop ejection and the preventing of color mixing. More specifically, rubbing areas of a nozzle orifice surface with a suitable wipe material, such as a resilient material, with 60 Shore A durometer fluorinated silicon rubber being one specific example, has been observed to increase ink contact angle in areas which are rubbed. Areas of a nozzle orifice surface which have not been wiped in this manner can more readily become contaminated with organic compounds. Apparently, the mechanical action of the wipe prevents the accumulation of contaminants which raise the surface energy of the coating and allow the ink to wet the nozzle orifice surface.

By pressing the blade 114, and in particular an elongated wipe surface 180 (FIGS. 5 and 6) of this blade, against the nozzle orifice surface 18 and moving the blade relative to the orifice surface in a squeegee-like operation, a wiping operation is performed and has proven to be an effective maintenance tool. More specifically, the performance of a wiping procedure is associated with increasing the contact angle and drool pressure of ink jet print heads, the drool pressure being the pressure internally within the head at which ink would tend to leak or drool from the orifices.

Although variable, the preferred wipe surface 180 is oriented in an upright plane and sized to span the entire transverse dimension of the nozzle orifice surface engaged by the wipe surface. The wipe surface is brought into contact with the nozzle orifice surface by shifting the purge chamber 40 toward the ink jet print head as explained below. As shown in FIG. 7, the wipe surface 180 engages the nozzle orifice surface 18 and wipes this surface as the ink jet print head 14 is moved relative to the wipe surface. In FIG. 7, wiping is accomplished during movement of the ink jet print head 14 in the direction of an arrow 182 from the position shown in solid lines in this figure to the position shown in dashed line in this figure. Bidirectional as well as unidirectional wiping may be accomplished. However, at present, unidirectional wiping is preferred so as to avoid leaving ink on the nozzle orifice surface 18 at the location where the wipe reverses direction.

Figure 5:
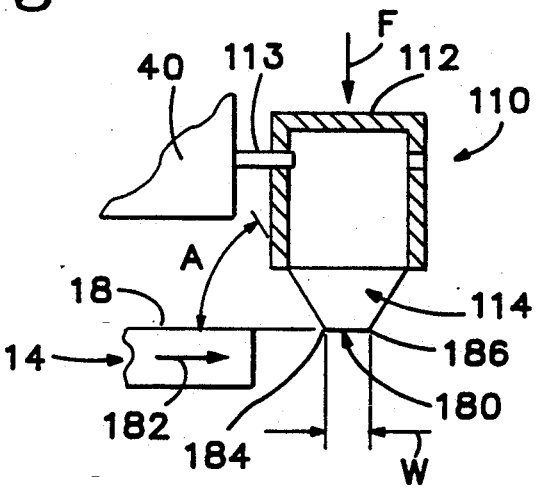
FIG. 5 is a top view, partially in section, of one form of a wipe mechanism in accordance with the present invention.

With reference to FIG. 5, movement of the ink jet print head 14 in the direction of arrow 182 (to the right in FIG. 5) is equivalent to movement of the wipe 114 to the left in this figure. Consequently, the wipe surface 180 has a first edge 184 which leads in the direction of relative motion between the wipe and nozzle orifice surface 18 and a trailing edge 186 which trails in the direction of motion. If the relative motion is too fast, the meniscus of ink which forms at the trailing edge of the wipe breaks off from the trailing edge in the form of minute drops of ink which can interfere with the printing operation. As one slows down the wiper speed, eventually the meniscus at the trailing edge follows the wipe to the edge of the nozzle orifice surface without breaking free and leaving minute ink drops on the surface. As a result, as the speed of the wipe decreases, the nozzle orifice surface 18 becomes cleaner.

As a specific preferred example, the wipe may be a 60 Shore A durometer fluorinated silicon rubber wipe with the wipe surface 180 having a width W of 0.03 inches. In this example, a force F of from 0.05 lbs. to 0.9 lbs., and preferably 0.65 lbs. is applied to the wipe, as indicated by the arrow F (FIG. 5), in a direction generally perpendicular to the plane of the surface 180. In this example, assuming the nozzle orifice surface 18 is coated with Teflon TM and the ink is a hot-melt ink, when wiped at speeds of no more than about 1.5 mm/seconds an extremely clean nozzle orifice surface 18 has been produced; that is, no isolated minute drops of ink were visually observed on the orifice surface.

It is also preferred that the blade 114 be tapered as shown in FIG. 5 so as to converge in a direction moving toward the wipe engaging surface 180. A typical angle of taper A, relative to the plane of surface 180, is from about 30° to about 80°, with 45° being preferred. However, the wiper geometry may be varied and the taper eliminated.

Ink accumulated on the face of an ink jet print head, whether hot-melt or aqueous ink, needs to be removed in a clean and predictable manner. As previously mentioned, the wipe 114 may be used for this purpose. However, any ink accumulated on the nozzle orifice surface can run off of the ink jet print head and onto electrical cables, the carriage or electronics beneath the ink jet print head. Ink in these areas would made ink jet print heads more difficult to adjust or replace. Also, ink is frequently corrosive to copper so that exceess ink on cables and electronics may affect the long term reliability of the equipment.

Figure 8:
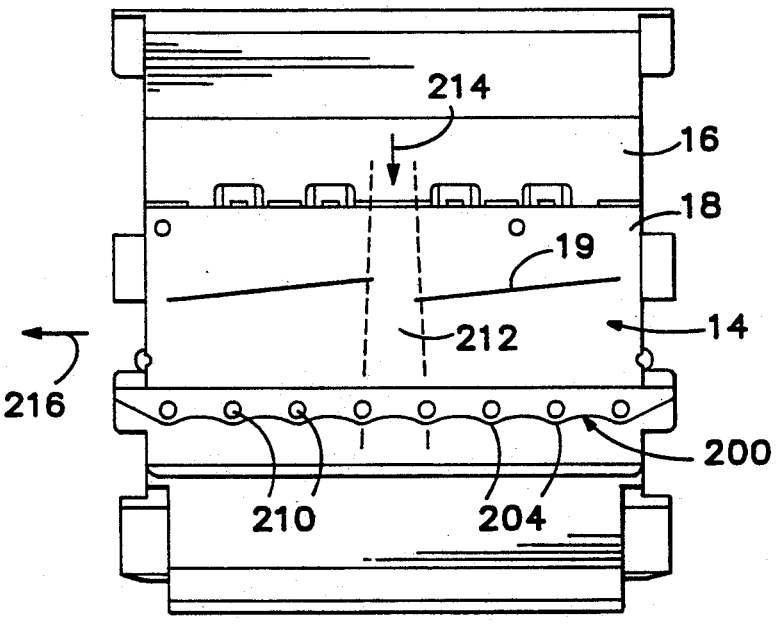
FIG. 8 is a front elevational of an ink jet print head having a drip edge in accordance with the present invention and illustrating the sweeping of the drip edge with air from an air knife.
Figure 9:
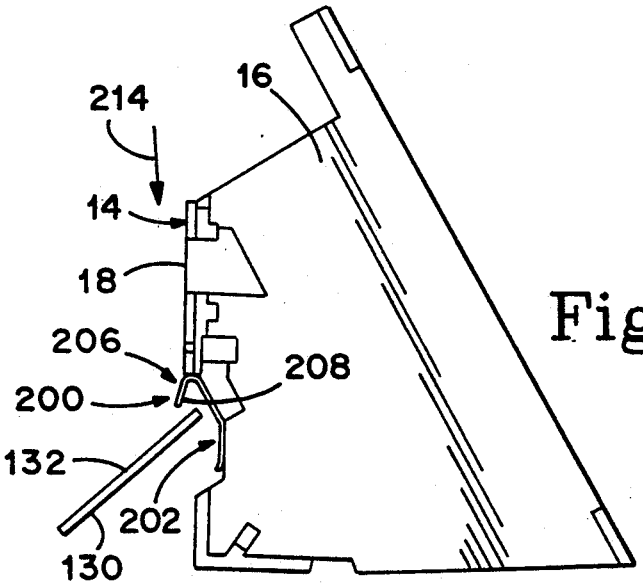
FIG. 9 is a side elevational view of the ink jet print head of FIG. 8.

To facilitate removal of ink from the nozzle orifice surface 18, as best seen in FIGS. 8 and 9, a drip edge 200 is secured in place directly beneath the nozzle orifice plate. Typically, the drip edge projects downwardly and outwardly relative to the nozzle orifice surface 18 (FIG. 9). In addition, the drip edge may comprise a generally inverted U-shaped component with a leg flange 202 shaped to abut the reservoir 16 for fastening thereto, as by mechanical fasteners such as rivets.

The drip edge 200 may be straight. However, preferably the drip edge has plural downwardly projecting ink drop concentrating serrations or projections, such as indicated at 204 in FIG. 8. A simple drip edge without drop nucleating sites or projections would allow the accumulation of a uniform wave of ink along the length of the drop edge, both along its front side 206 and back side 208. The ink wave on the back or underside of the drip edge 200 could grow to the point wherein it wicks up to the bottom of the ink jet print head and then down the ink reservoir to electronics positioned therebelow. It is possible to extend the drip edge far enough from the head to prevent this ink wicking action. However, this would require additional space for the drip edge. Also, the drip edge is typically heated by conduction from the reservoir and ink jet print head when hot-melt ink is used. Extending the drip edge 200 too far from the ink jet print head and reservoir would result in ink freezing and building up unacceptably on the edge. With these constraints, by providing serrations or drop nucleating projections 204 along the drip edge, drops form on the tips of these serrations where they more readily break free than a continuous wave of ink along a straight drip edge. However, large drops could also still form on the under side 208 of the drip edge.

By placing plural apertures, some being indicated at 210 at FIG. 8, with each such aperture preferably being positioned above an associated respective one of the serrations 204, it has been found that drops form and fall off the projections 204 without significant build up at the underside 208 of the drip edge. The apertures are sufficiently large to avoid ink forming a meniscus over them. The apertures reduce the amount of surface at the drip edge for drops to cling to, thereby resulting in the formation of less stable drops. These drops grow until they fall under their own weight or until removed under the action of the airstream of the air knife 90 (FIG. 1). For hot-melt ink of a viscosity of from 10 centipoise to about 50 centipoise, suitable openings 210 are from about 0.15 inch to about 0.2 inch in diameter.

Indicated schematically in FIG. 8 by the number 212, is a representation of an airstream from a source 214 such as the air knife 90. As the ink jet print head is moved in the direction of arrow 216, the airstream sweeps ink from the nozzle orifice surface 18 and also from the drip edge 200. As shown in FIG. 9, the ink collector 130 is preferably positioned beneath the airstream so that ink blown from the nozzle orifice surface and the drip edge 200 is collected on the upper surface 132 of the collector.

Figure 13:
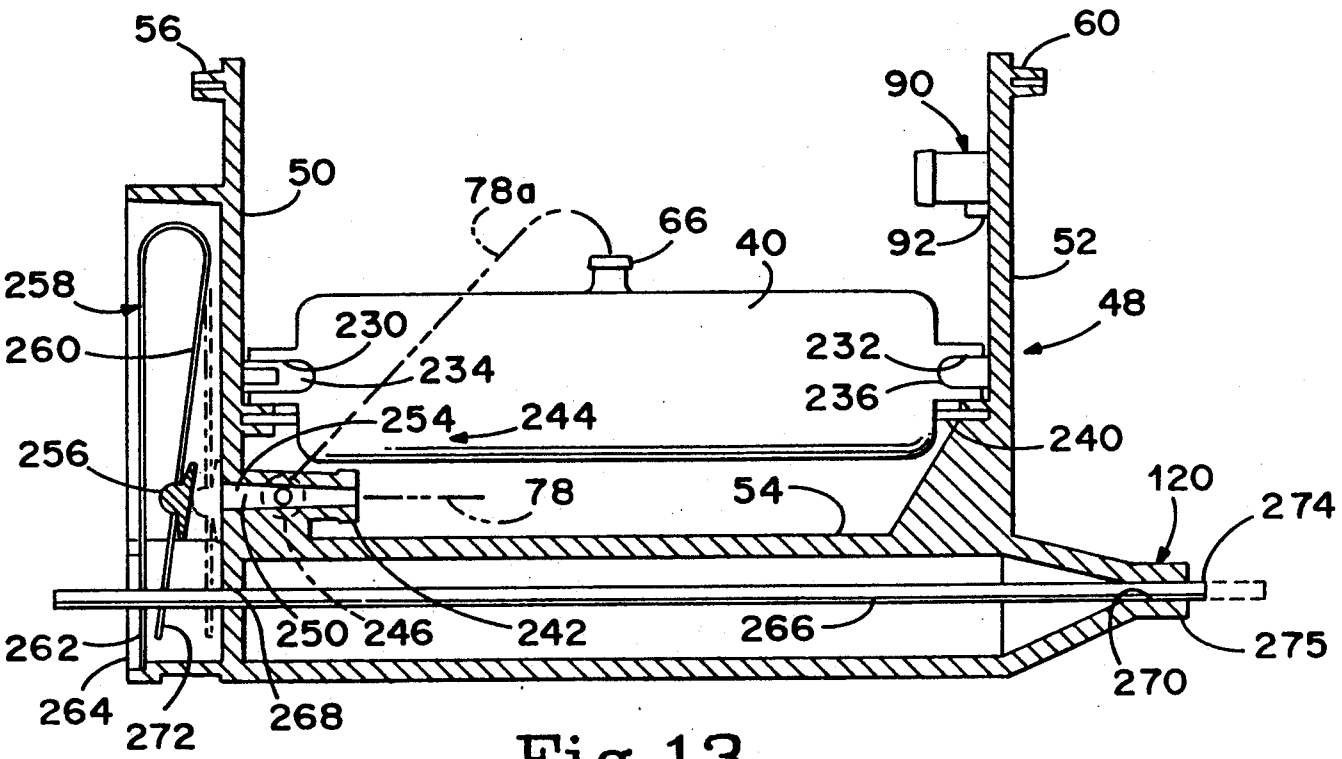
FIG. 13 is a vertical sectional view through the purge chamber support of the system of FIG. 1 and illustrating the opening and closing of a vent port leading to the purge chamber.
Figure 14:
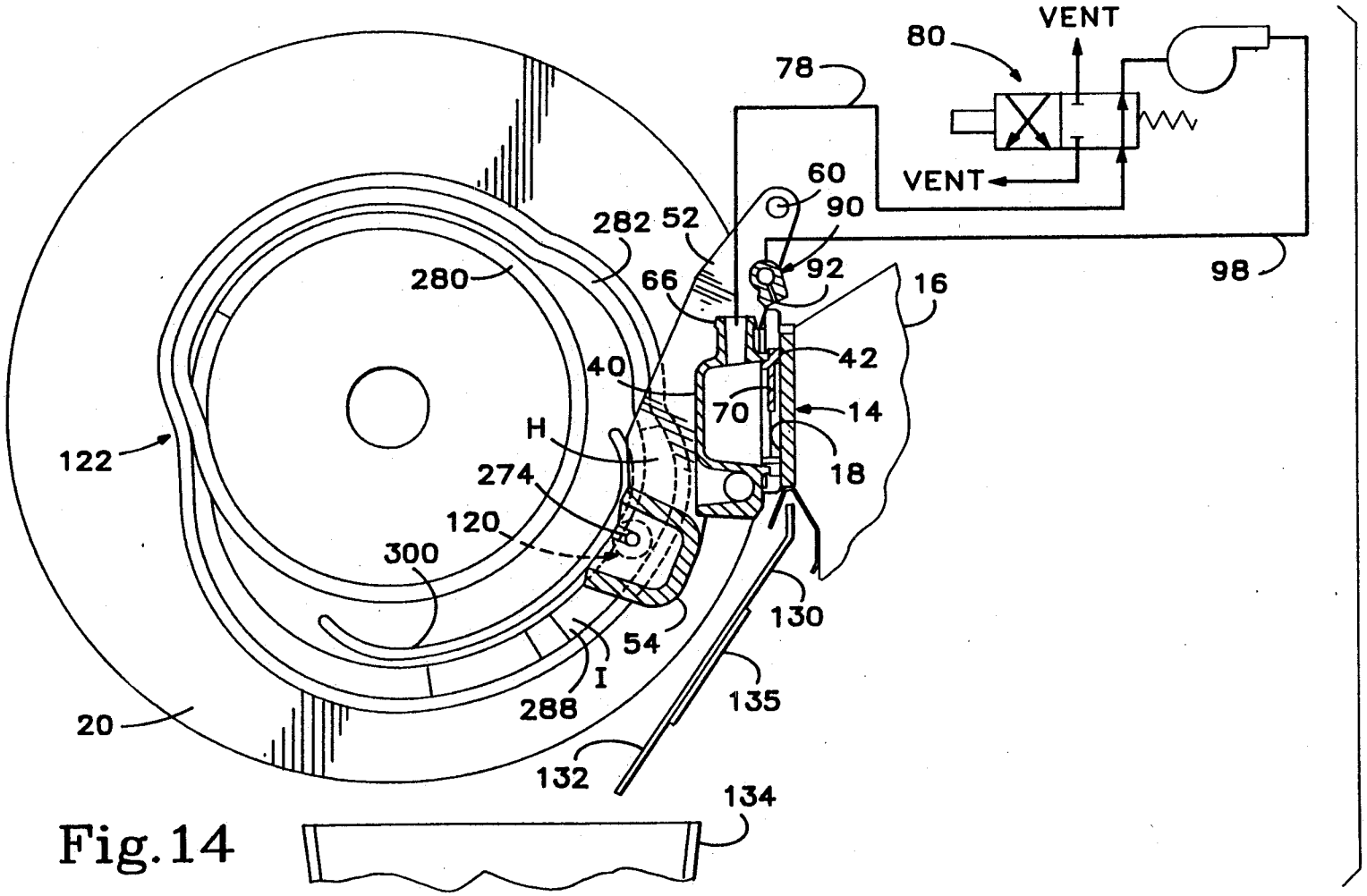

With reference to FIGS. 1, 2 and 13, the purge chamber 40 nests between the arms 50 and 52 of the support 48. The purge chamber 40 is formed with respective pin receiving grooves 230, 232. The grooves 230, 232 which respectively engage pins 234, 236 which project inwardly from the legs 50, 52 of the support 48. A resilient biasing element, such as a leaf spring 240 holds the purge chamber in place and biases the purge chamber against the nozzle orifice surface 18 when the purge chamber 40 is shifted to the purge position.

As is shown in these figures, the suction line 76 (FIG. 1) of the pump and conduit 78 (FIGS. 1, 2 and 13) may be coupled to an inlet 242 (FIG. 13) of a relief valve assembly 244 with an outlet 246 of the relief valve assembly being coupled by a conduit section 78a to the vacuum port 66. An internal passage way 250 couples the inlet 242 to the outlet 246 and provides a connection through which a vacuum may be drawn when the purge chamber 40 is in the purge position.

The passageway 250 has a vent outlet 254 which is selectively opened and closed, as by a valve 256 to vent the purge chamber. The valve or seal 256 is opened to relieve the vacuum in the purge chamber prior to moving the purge chamber away from the nozzle orifice surface following a purge operation. Consequently, the purge chamber may readily be withdrawn from its purge position without needing to overcome the previously applied vacuum. Although valve 256 may be operated in other ways, such as by a solenoid, in the illustrated form the valve 256 comprises a resilient cap, such as of neoprene rubber which is mounted to a leg 260 of a U-shaped spring 258. The other leg of this spring is retained in place by a wall 264 of the support leg 50. An elongated pin or rod 266 is slidable within the hollow interior of the support base 54. The pin 266 is longitudinally slidable within an aperture 268 through a wall of the support leg 50 and an aperture 270 through a barrel 275 of the ca follower mechanism 120. The pin 266 engages leg 260 of the spring 258 at the location indicated generally at 272 in FIG. 13. The pin 266 in this embodiment has a distal end 274 which comprises the cam follower of cam follower mechanism 120. As the pin 266 (and more specifically pin end 274) follows the cam 122 (FIG. 1 and FIGS. 10–12 and 14–17) the distal end 274 of the pin is shifted from a position shown in dashed lines in FIG. 13 to the position shown in solid lines in this figure. When the pin is in the position shown in solid lines, the valve 256 is spaced from the vent opening 254 and the purge chamber is vented. Conversely, when the pin end 274 is in the dashed line position shown in FIG. 13, the valve 256 is shifted to the position shown in dashed lines in this figure so as to close the vent opening 254 and permit the drawing of a vacuum within the purge chamber.

Figure 10:
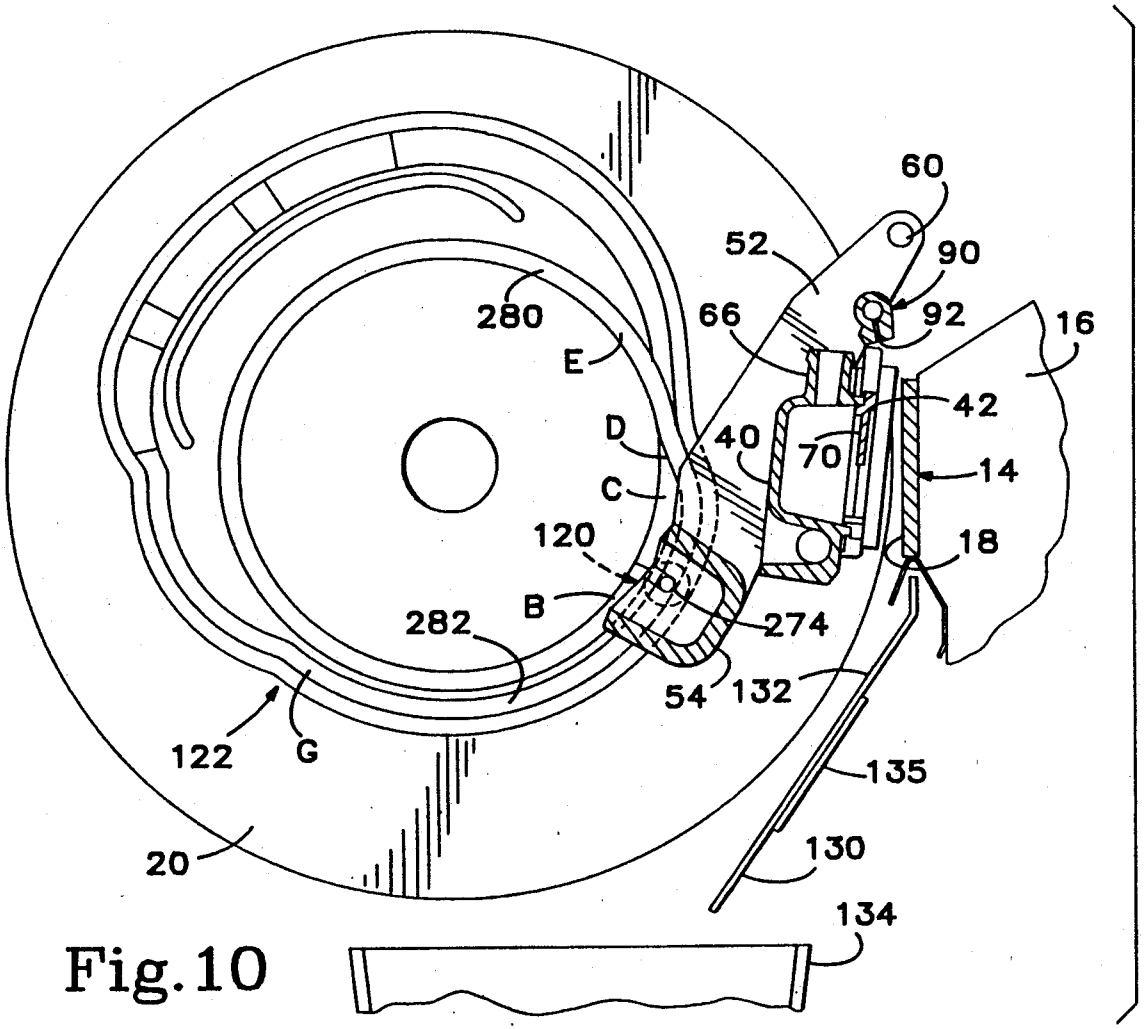
FIGS. 10–12 and 14–17 illustrate the operation of a cam drive mechanism on a drum of a printer as the cleaning and maintenance system is operated through its various steps.

The operation of the cam 122 during the cleaning and maintenance of an ink jet print head 14 will be described in conjunction with FIGS. 10–17. FIG. 10 represents the position of the cam follower 274 following the printing of a long print and also shows the position of the cam follower 274, in dashed lines, following the printing of a short print, with the printer ready to print another print. From the short print home position shown in dashed lines, the cam follower 274 climbs a ramp C, drops over a cliff D, and continues following a cam track 280 until a location, such as location B, is reach when the print has been printed. To eject the print, the direction of drum rotation is reversed with the cam follower following the inner track 280 until a location, such as location E, is reached. In the case of a long print, during printing the cam follower will follow track 282 and will be guided past the cliff D to the track 280 until the location B is reached. The print is unloaded by reversing this path of travel. The cam follower may end up at a point, such as point G, during unloading of the print. The drum is then rotated back to the home position as shown in FIG. 10. While the cam follower 274 is in the inner track 280, it follows a circle and does not shift the purge chamber 40 toward the ink jet print head 14. Similarly, while the cam follower 274 is in the cam track 282, although minor shifting of the purge chamber 40 takes place, the purge chamber is not shifted against the nozzle orifice surface 18. In addition, at these times, the valve 256 (FIG. 13) is closed. Also, the pump 74 (see FIG. 1) is off. The position of the drum 20 may be detected in any conventional manner, such as optically or by counting drive pulses from a stepper motor used to drive the drum.

Figure 11:
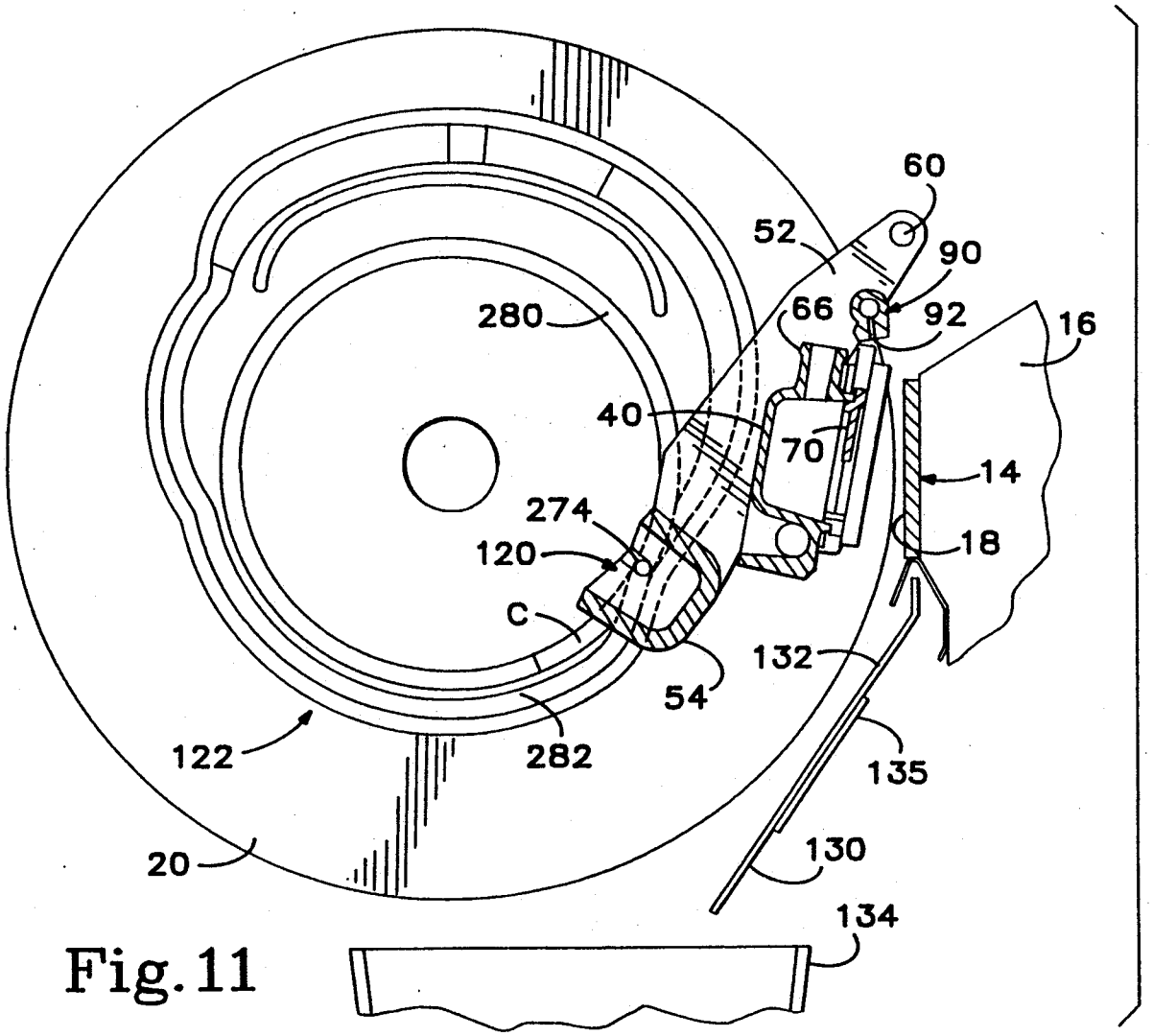

To perform a purge cycle of the ink jet print head, the ink jet print head is moved to a maintenance position in alignment with the purge chamber 40. In addition, the cam follower is shifted to a start position as shown in FIG. 11, wherein the purge chamber 40 is fully retracted by the cam follower 274 away from the ink jet print head. In addition, the valve 256 is still closed and the pump remains off.

From the position shown in FIG. 11, the drum 20 is rotated to cause the cam follower to travel up a ramp H of a cam track 288 which causes the cam follower (the end 274 of pin 266, FIG. 13) to be shifted to the position shown in solid lines in FIG. 13. As a result, the valve 256 is shifted to the position at which the passageway 250 and purge chamber 40 is vented. A projecting flange 300 bears against the side of the barrel 275 of cam follower mechanism 120 while the cam follower 274 is in the track section 288. This relieves any radial load on the pin end 274, thereby facilitating its movement. Also, inasmuch as the radial distance between the center of the drum 20 and the track section 28 is greater than the radial distance to either of the track sections 280 or 282, the purge chamber 40 is moved into a position with the gasket at rim 42 sealed against the nozzle orifice surface 18. Continued rotation of the drum shifts the cam follower 274 along track section 258 to a downwardly inclined ramp I. As the cam follower moves down the ramp I, the pin end 274 (FIG. 13) shifts to the dashed position shown in this figure and causes the valve 256 (FIG. 13) to close the vent opening 254. This allows a vacuum to be drawn in the purge chamber 40 inasmuch as the pump 74 is on at this time and the valve 80 is shifted to the position shown in FIG. 14. The cam follower 274 remains at this position until the desired vacuum is achieved, for example about four seconds. During this time the ink jets of the ink jet print head are operated to jet inks and the flow of ink into the purge chamber 40. The flow of ink removes bubbles and other contaminants from the ink jet nozzle orifices. Following the purge, the drum is rotated such that the cam follower 274 climbs the ramp I and the valve 256 is opened to break the vacuum in the purge chamber 40 prior to the cam follower 274 reaching the location where the purge chamber is withdrawn from the nozzle orifice surface 18.

Figure 15:
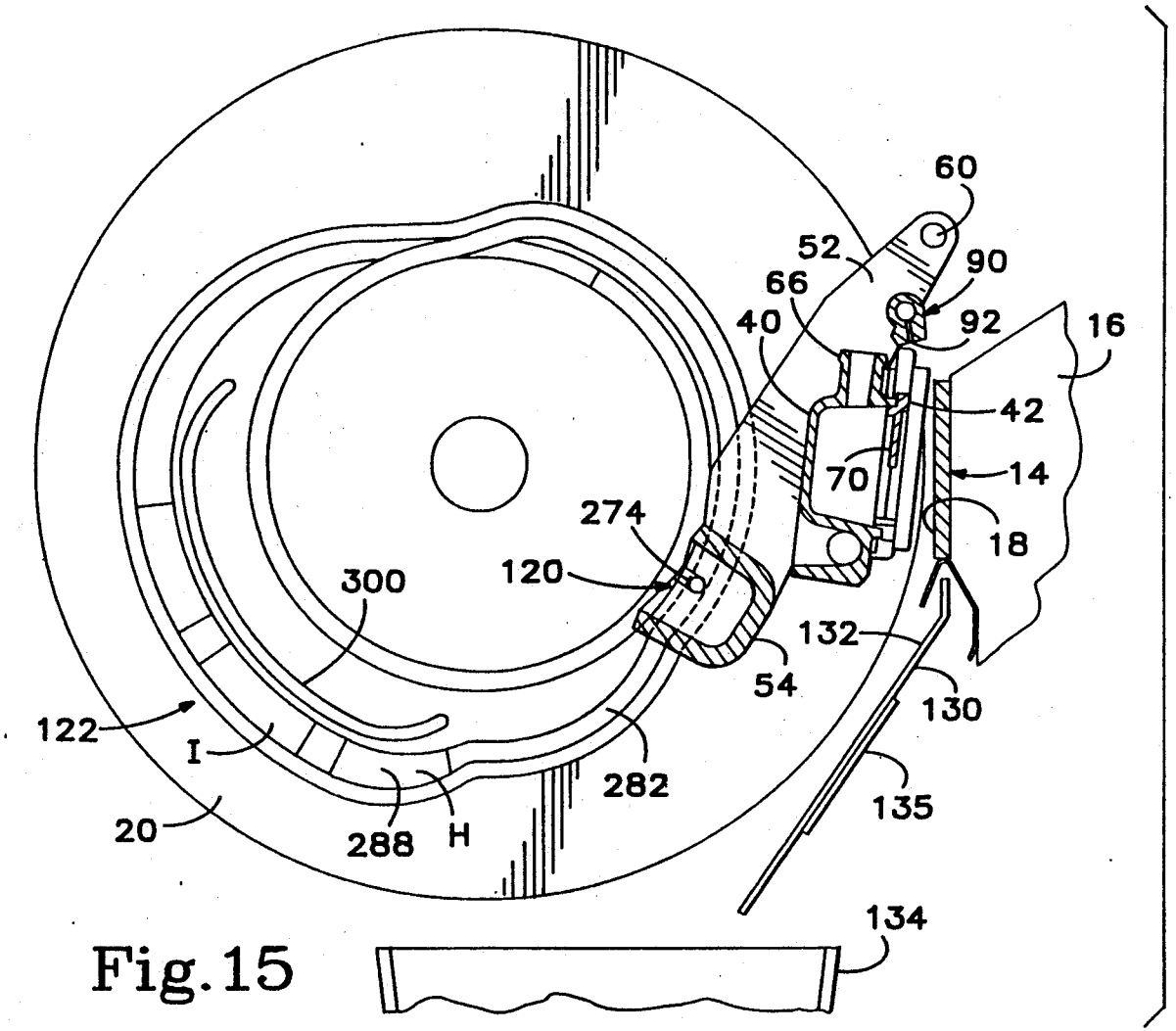

As shown in FIG. 15, the cam follower is again returned to a position wherein the purge chamber is retracted from the nozzle orifice surface 18 and the valve 256 is again closed.

Figure 16:
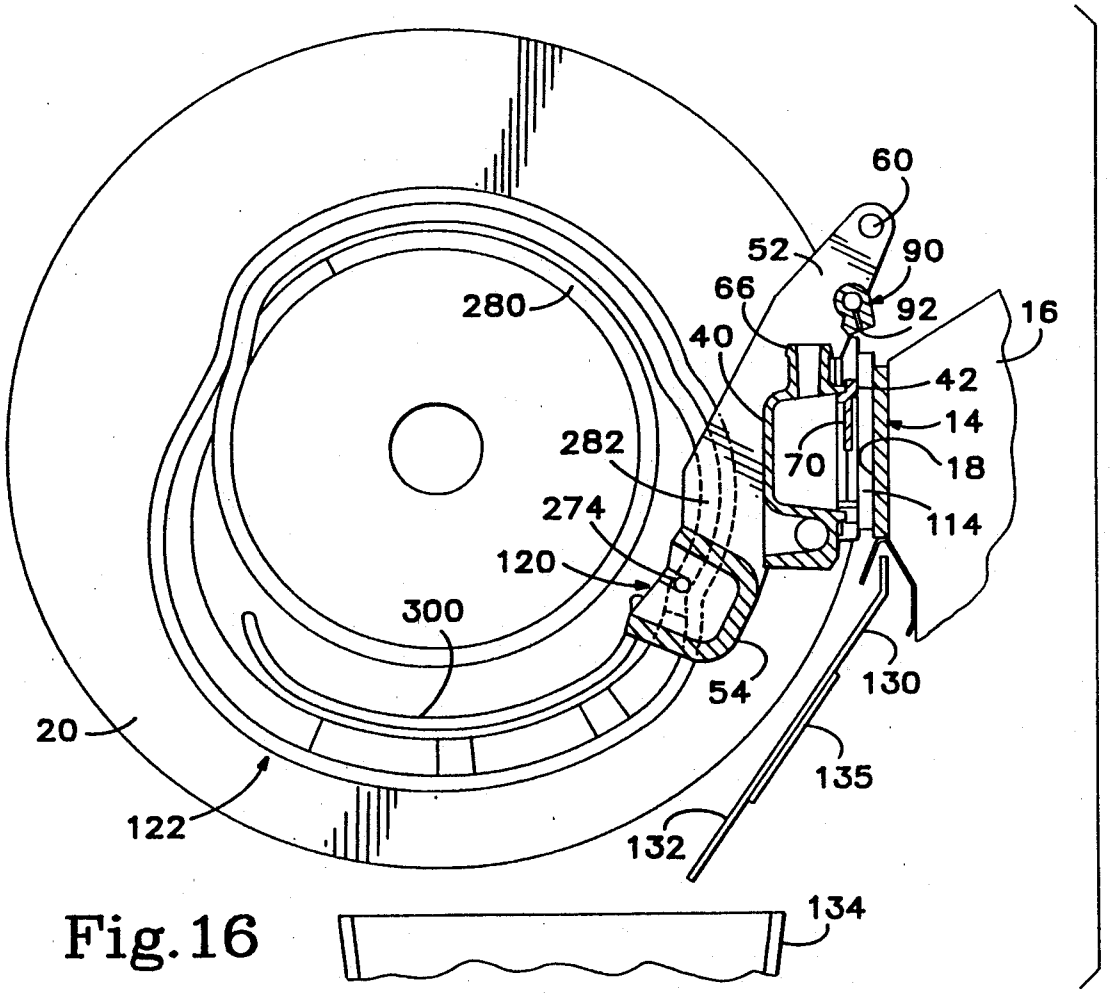
Figure 17:
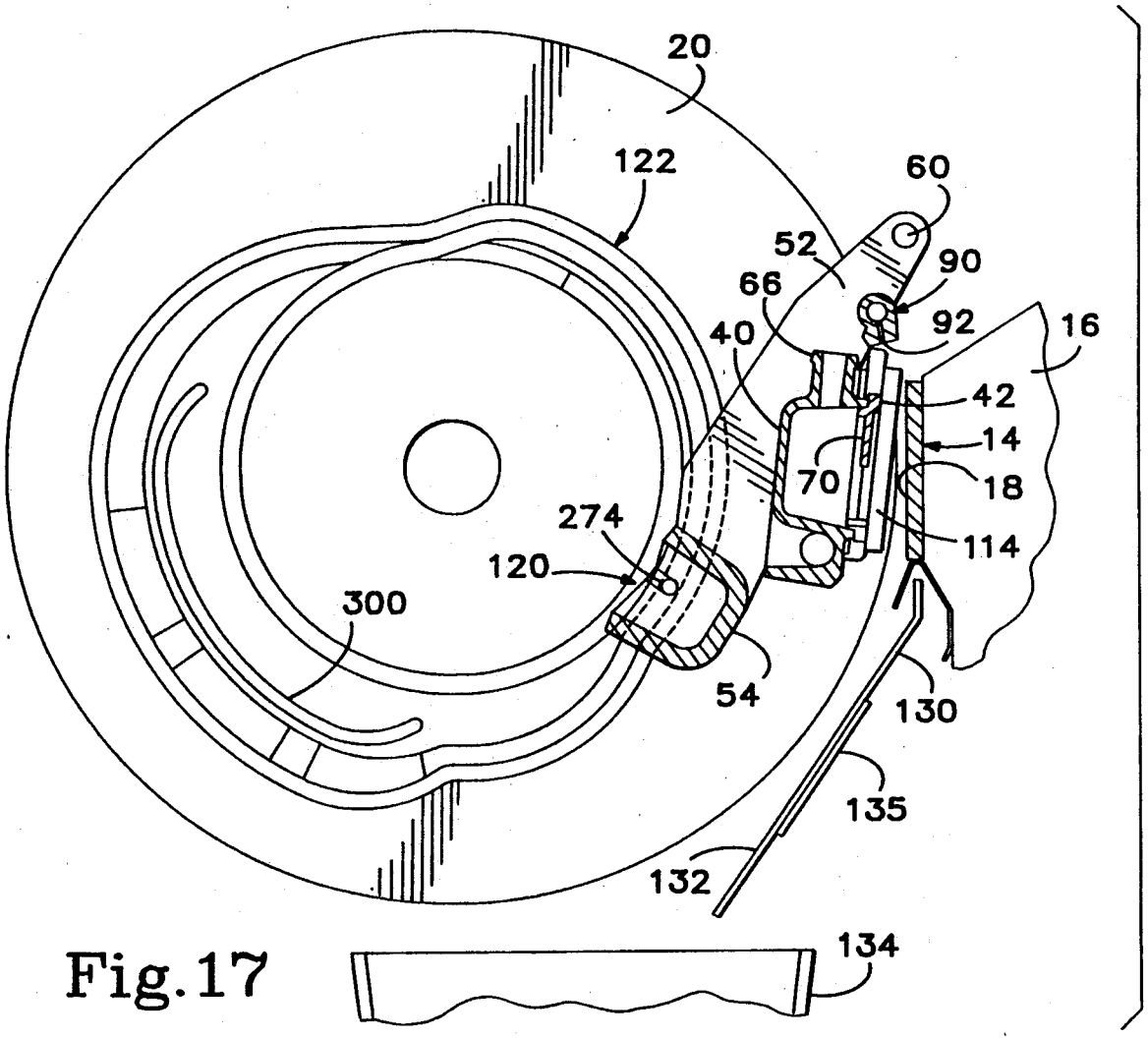

The purge chamber is then shifted to the position shown in FIG. 16 with the ink jet print head moved such that the wipe 114 abuts the nozzle orifice surface 18. Under these conditions, shifting of the ink jet print head wipes the ink jet print head (as described above in connection with FIG. 7). Following the wipe cycle, the drum 20 is rotated to the position shown in FIG. 17 resulting in the retraction of the purge chamber and wipe 114 away from the nozzle orifice surface. The valve 256 (FIG. 13) is again closed and the pump is on. This directs air from the air knife 90 across the nozzle orifice surface as previously explained. The nozzle orifice surface is then moved past the air knife without simultaneously wiping the surface with the wiper to thereby accomplish an air knife cleaning cycle.

It will be appreciated that the above described cleaning or maintenance system may be operated to accomplish a complete cleaning and maintenance cycle involving one or more purges of the ink jet print head together with a wipe cycle followed by an air knife cycle. Also, partial maintenance operations may be performed by positioning the components for an air knife cleaning operation only, a wipe operation, or a wipe operation followed by an air knife cleaning operation.

Figure 18:
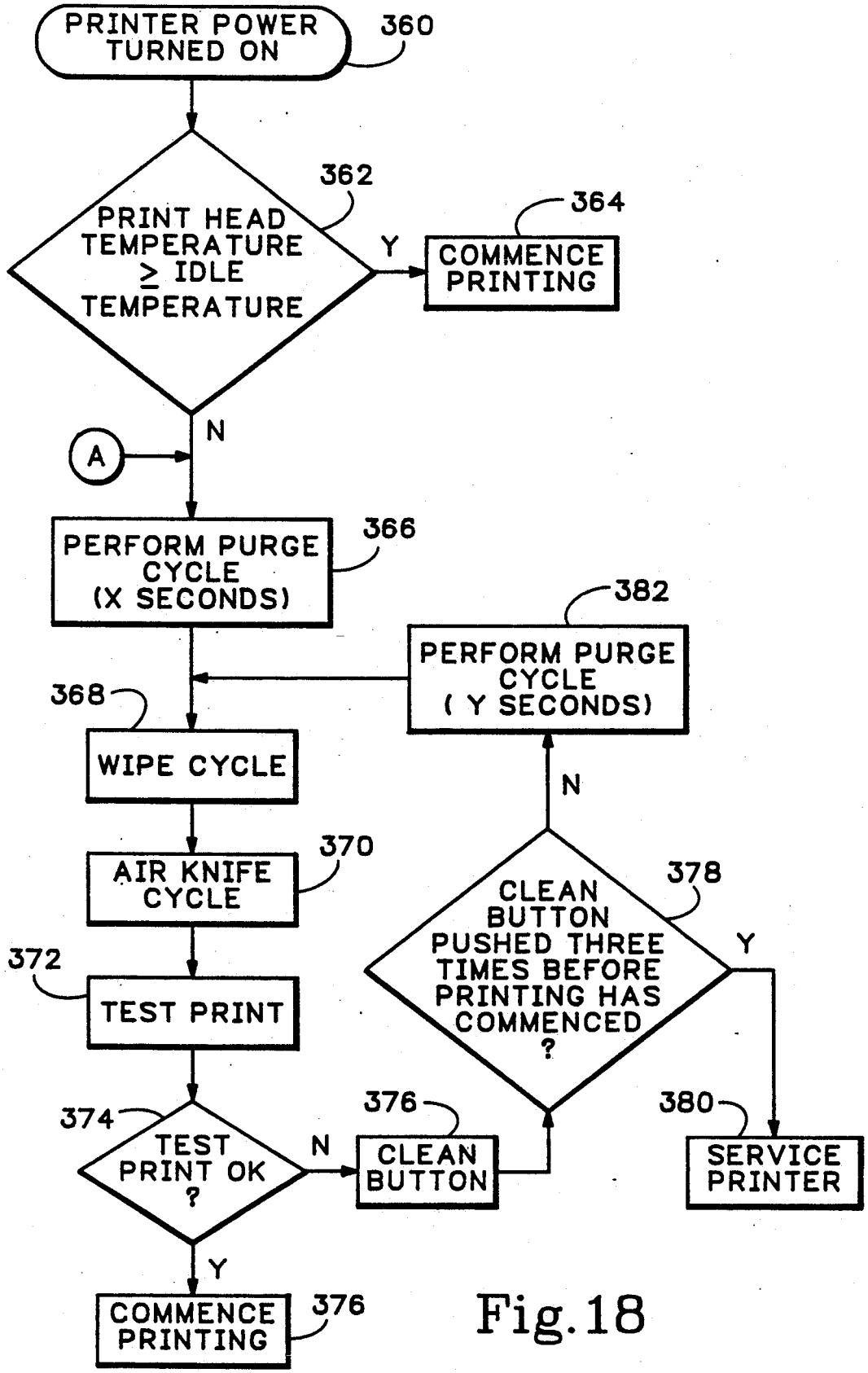
FIGS. 18–21 are flow charts of cleaning and maintenance steps performed in accordance with the present invention.
Figure 19:
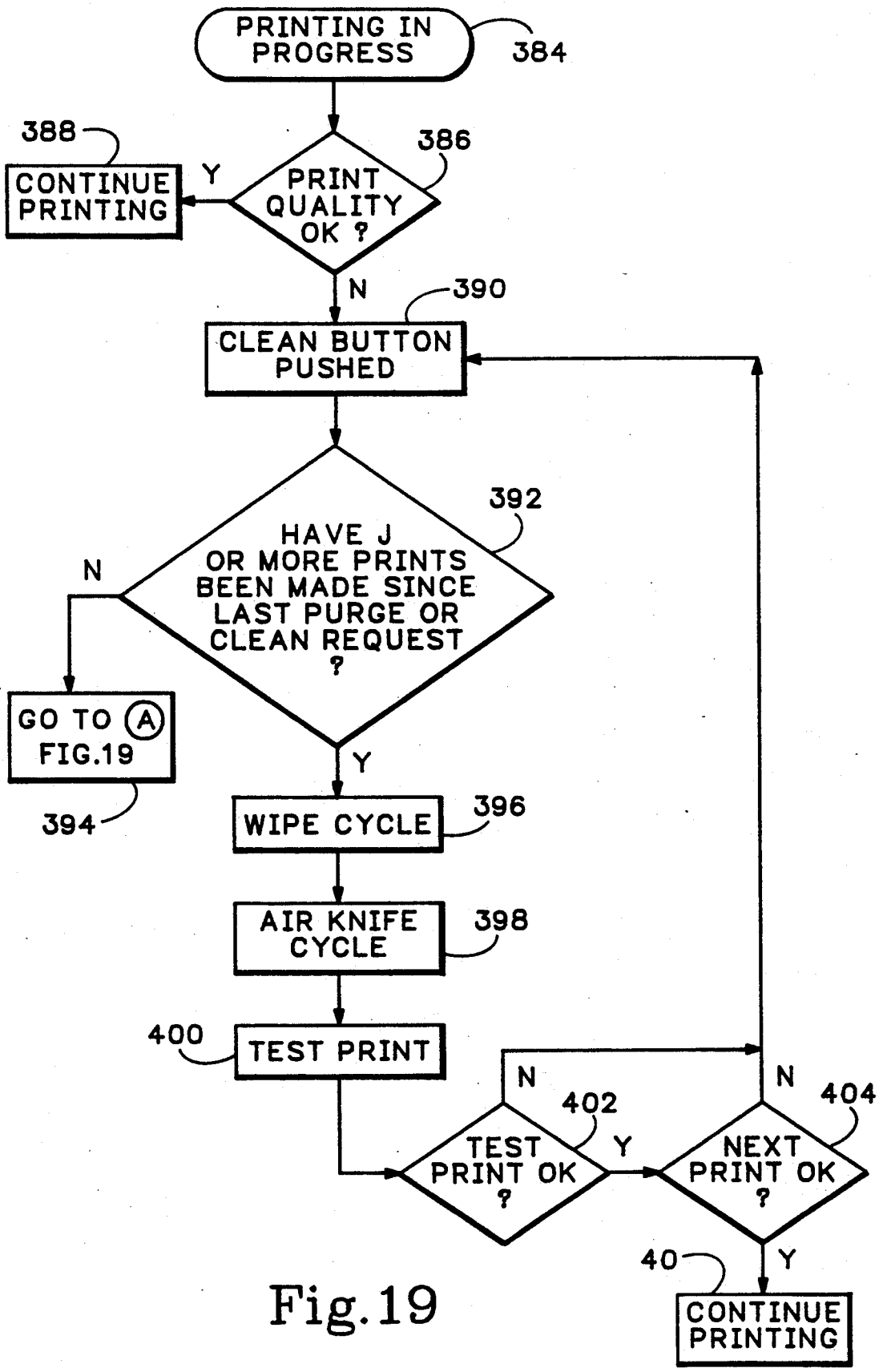
Figure 20:
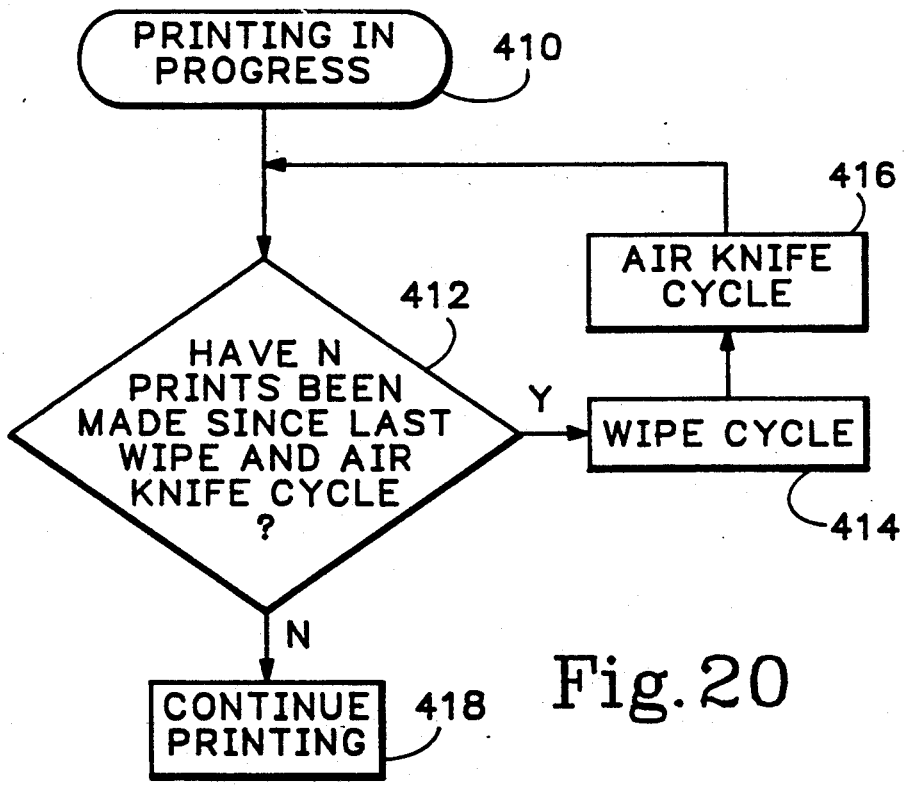

Although variable, a preferred mode of operating the cleaning or maintenance system of the present invention is set forth in the flow charts of FIGS. 18–20.

With reference to FIG. 18, assume the power to the printer is turned on at block 360. At a block 362, in the case of a hot-melt or phase-change ink jet printer, the question is asked as to whether the temperature of the ink jet print head is greater than or equal to an idle temperature, such as determined by a temperature probe, not shown. If so, a block 364 is reached and printing commences. If not, an indication is made that the printer has been shut down for a period of time. Inasmuch as hot-melt ink shrinks when it cools, the possibility exists that an air bubble has been ingested into the nozzle orifice openings as the ink cooled. To alleviate this potential problem, a purge cycle is performed as indicated at block 366. In a purge cycle, the ink jet print head is shifted to the maintenance position and the purge chamber is engaged with the nozzle orifice surface with the vacuum being drawn and most preferably the ink jet or jets being operated to eject ink into the purge chamber. The purge cycle involves achieving a pressure differential across the nozzle orifices. Preferably this is accomplished by the application of a vacuum, but it may also be accomplished by coupling a pressure source to the ink chamber to raise the pressure of ink within the ink jet print head. For example, the first purge cycle may be of a predetermined duration, such as X seconds. In one specific example, X is equal to four, which equates to about eight grams of ink being ejected during a purge cycle.

Following the initial purge cycle, a wipe cycle may be performed at block 368. The wipe cycle corresponds to engaging the nozzle orifice surface 18 with the wipe 114 and moving these components relative to one another to wipe ink from the nozzle orifice surface. The air knife may be turned on simultaneously with the wiping action or, alternatively, may be turned off. Following the wipe cycle, an air knife cycle is typically performed as indicated at block 370 to further clean residual ink from the nozzle orifice surface and from the ink jet print head drip edge. During the air knife cycle, the ink jet print head is moved relative to the air knife so that a stream of air is directed across the nozzle orifice surface. Following the purge, wipe, and air knife cycle steps, a test print is run as indicated at block 372 and at block 374 an inquiry is made as to whether the test print is satisfactory. The user of the printer may make this determination visually. If so, a block 376 is reached and printing commences. If not, a clean control button, not shown, may be depressed by the user with the drum 20 being shifted to perform one or more additional cleaning cycles. However, optionally, to limit the number of purge cycles, from block 376 an inquiry may be made at block 378 as to whether the clean button has been pushed a predetermined number of times, such as three, before printing has commenced. If so, a block 380 is reached and the printer is serviced or otherwise cleaned, apart from the cleaning and maintenance system. If the answer at block 378 is no, a block 382 is reached and another purge cycle is performed. Again, the purge cycle may be of a predetermined duration, such as Y seconds. Although first and subsequent purge cycles may be of the same duration, preferably, the second successive purge cycle is of a longer duration, such as about six seconds, corresponding to about 20 cc of ink being ejected from the ink jet print head during the purge cycle. From block 382, the block 368 is again reached with successive wipe and air knife cycles being performed and the printer again being tested to see if satisfactory printing is occurring.

With reference to FIG. 19, assume printing is underway as indicated at block 384. At any time, the operator of the printer may examine prints to determine whether the print quality is satisfactory, as indicated at block 386. If the answer is yes, printing continues as indicated at block 388. If the answer is no, a block 390 is reached with the clean button being pushed. From block 390, a block 392 is reached at which time an inquiry is made as to whether a predetermined number of prints, such as J or more prints, have been made since the last purge cycle. For example, J may be set at two or more prints. If the answer is no, it is likely that the previous purge operation did not adequately clear bubbles and other contaminants from the ink jet print head. Therefore, a block 394 is reached and the process returns to point A in FIG. 18 with the complete cleaning and maintenance cycle being performed as previously described. However, if two or more prints have been made since the last purge, as determined at block 392, it is likely that paper fiber or dust is the cause of the degradation in quality. In this case, the purge cycle is bypassed with a wipe cycle and air knife cycle being performed in successive steps as indicated at blocks 396 and 398. Following these maintenance procedures, a test print is made at block 400 and at block 402 a determination is made as to whether the quality of the test print is satisfactory. If not, the block 390 is reached, the clean button is pushed again, and cleaning continues. If at block 402 a determination is made by the user of the printer that the test print is satisfactory, a block 404 is reached with the inquiry being made by the user of the printer as to whether the next print is also of satisfactory quality. If so, printing continues at block 406. If the answer at block 404 is no, the operator or user may again push the clean button at 390. From block 390, via either the block 402 or the block 404, the block 392 is again reached. However, this time there has been less than two or more prints since the last purge or clean request. Consequently, the block 394 is reached and purging continues at point A in FIG. 18.

Figure 21:
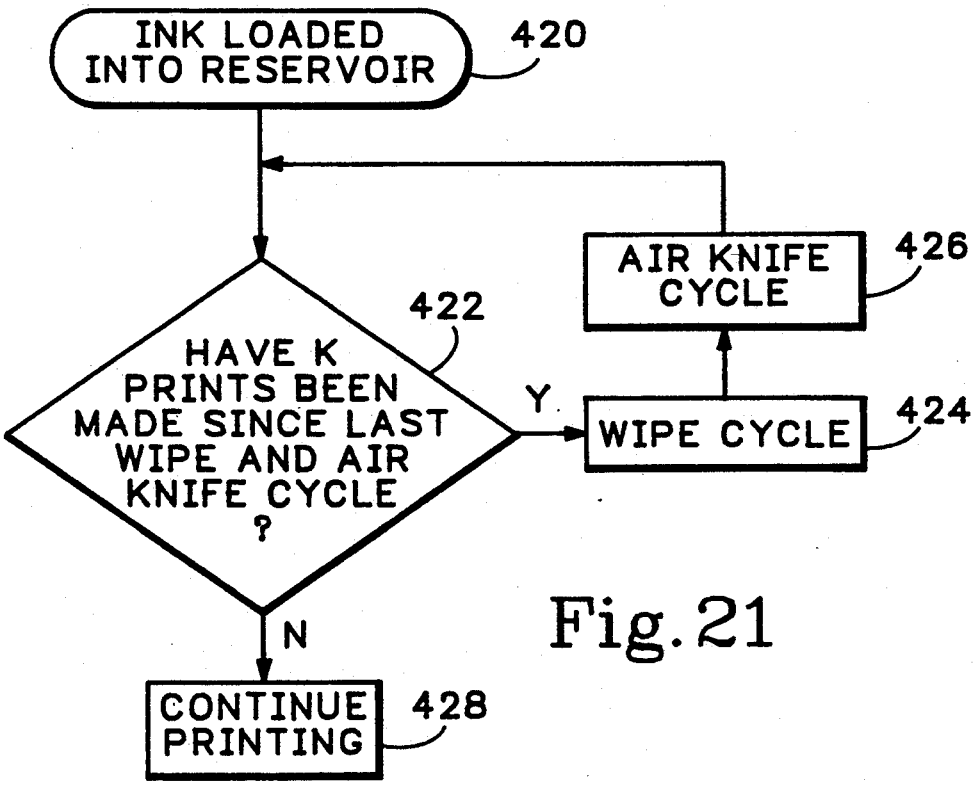

FIGS. 20 and 21 relate to automatic cleaning and maintenance procedures. With reference to FIG. 20, assume printing is in progress as indicated at block 410. The printer counts the prints as they are being made in a conventional manner and at block 412 a query is made as to whether a predetermined number of prints, namely N prints, have been made since the last wipe and air knife cycle. If the answer is yes, at blocks 414 and 416, successive wipe and air knife cycles are performed to maintain the ink jet print head. If the answer at block 412 is no, printing continues at block 418. N may be set at any magnitude and may be varied. Presently, N is preferably set at fifty to ensure that cleaning and maintenance takes place periodically under heavy usage of the printer.

Conventionally, ink is loaded into the ink reservoir 16 from time to time as required to accomplish printing. A suitable sensor, not shown, may be utilized to sense the loading of ink as indicated at a block 420 in this figure. From block 420, a block 422 is reached at which time an inquiry is made as to whether a predetermined number of prints, K prints, have been made since the last wipe and air knife cycles. If the answer is yes, corresponding to a relatively high volume of ink being used, wipe and air knife cycles are performed at the respective blocks 424 and 426 with the process returning to block 422. If the answer at block 422 is no, a block 428 is reached and printing continues. Although K may be varied and may be adjusted during operation of the printer, presently a preferred value of K is ten prints.

Having illustrated and described the principles of our invention with reference to a preferred embodiment, it should be apparent to those of ordinary skill in the art that this invention may be modified in arrangement and detail without departing from such principles. We claim as our invention all such modifications as fall within the spirit and scope of the following claims.

We claim:

1. In an ink jet print head cleaning or maintenance system for cleaning an ink jet print head having an ink jet nozzle orifice surface containing at least one orifice through which ink drops are ejected the improvement comprising:

a purge chamber having an interior, an ink jet print head engaging surface for selectively engaging the ink jet nozzle orifice surface to form a closed interior, the engaging surface surrounding an ink receiving opening which communicates with the interior of the purge chamber, a baffle extending substantially across the ink receiving opening, and a vacuum port extending into the interior at such a position that ink entering the purge chamber impinges on the baffle and does not pass directly to the vacuum port; and vacuum means for drawing a vacuum at the vacuum port while the ink jet print head engaging surface engages the ink jet nozzle orifice surface to form a closed interior so as to form a relative vacuum within the purge chamber to accelerate the flow of ink from the ink jet nozzle orifice through the ink receiving opening and into the interior of the purge chamber.

2. A maintenance system according to claim 1 in which the baffle comprises an upright baffle with a lower edge margin, the lower edge margin including drop concentrating projections which direct ink flowing down the baffle into drops away from openings in the baffle.

3. A maintenance system according to claim 1 in which the ink receiving opening is upright and has a lower portion, the system including a dam extending across the lower portion of the ink receiving opening, the dam having plural spillways with closeable outlets that are closed when the ink jet print head engaging surface engages the ink jet nozzle orifice surface and through which outlets ink held within the interior of the purge chamber by the dam exits from the purge chamber.

4. A maintenance system according to claim 3 wherein the spillways comprise slits which concentrate the flow of ink from the purge chamber into a respective narrow stream associated with each slit.

5. A maintenance system according to claim 3 wherein the dam has an upper edge surface which is sloped downwardly toward the interior of the purge chamber.

6. A maintenance system according to claim 3 in which the baffle comprises an upright baffle with a lower edge margin, the lower edge margin being spaced from the dam, the dam having an upper edge surface, at least a portion of the lower edge margin of the baffle extending below the upper edge surface of the dam.

7. A maintenance system according to claim 3 in which the spillways comprise slits which concentrate the flow of ink from the chamber into a respective narrow stream associated with each slit, the dam having an upper edge surface which is sloped downwardly toward the interior of the purge chamber, and the lower edge margin of the baffle including drop concentrating projections extending downwardly below the upper edge surface of the dam.

8. A maintenance system according to claim 3 in which the dam and baffle are formed integrally with a gasket, the gasket including a rim which surrounds the ink receiving opening and forms the ink jet print head engaging surface.

9. A maintenance system according to claim 1 further comprising a downwardly inclined drip collector positioned below the ink receiving opening and an ink receptacle positioned to receive ink from the ink collection surface, the drip collector having an upper ink collection surface positioned to receive ink from the purge chamber when the ink jet print head engaging surface is not selectively engaging the ink jet nozzle orifice surface and to direct such received ink along the ink collection surface.

10. A maintenance system according to claim 9 adapted for a hot-melt ink jet printer and including a heater for heating the purge chamber and a heater for heating the drip collector to melt hot-melt ink on such drip collector such that the melted ink flows along the ink collection surface to the ink receptacle.

11. A maintenance system according to claim 10 including an air knife positioned to direct air downwardly in an air stream across only a portion of the ink jet nozzle surface, ink swept from the ink jet nozzle surface by the air stream passing to the drip collector.

12. A maintenance system according to claim 1 further comprising an air knife positioned to direct air downwardly in an air stream across only a narrow portion of the ink jet nozzle surface when the ink jet print head engaging surface is not selectively engaging the ink jet nozzle orifice surface.

13. A maintenance system according to claim 11 in which the ink jet print head includes a print head drip edge projecting downwardly below the ink jet nozzle orifice surface from which ink is swept by the air knife.

14. A maintenance system according to claim 13 in which the print head drip edge has downwardly projecting ink drop concentrating projections.

15. A maintenance system according to claim 14 in which the print head drip edge has plural perforations for limiting the size of ink drops on the drip edge.

16. A maintenance system according to claim 1 in which the ink jet print head includes a print head drip edge projecting downwardly below the ink jet nozzle orifice surface.

17. A maintenance system according to claim 1 in which the print head drip edge has downwardly projecting ink drop concentrating projections.

18. A maintenance system according to claim 17 in which the ink jet print head drip edge has plural perforations for limiting the size of ink drop of the drip edge.

19. A maintenance system according to claim 18 including a wipe with an elongated wipe surface and a mount supporting the wipe for selective engagement of the wipe surface to the ink jet nozzle orifice surface to wipe ink from the ink jet nozzle orifice surface.

20. A maintenance system according to claim 19 including means for moving the wipe and ink jet nozzle orifice surface relative to one another at a rate which is no greater than about 1.5 mm/second.

21. A maintenance system according to claim 19 in which the wipe surface has a leading edge and a trailing edge, the former leading the latter in the direction of motion of the wipe across the ink jet nozzle orifice surface, the system including means for moving the engaged wipe and ink jet nozzle orifice surface relative to one another at a rate which substantially eliminates the formation of ink drops on the ink jet nozzle orifice surface behind the trailing edge of the wipe.

22. A maintenance system according to claim 19 in which the wipe is mounted to the purge chamber.

23. A maintenance system according to claim 1 adapted for a hot-melt ink jet printer and including a heater for heating the purge chamber.

24. A maintenance system according to claim 22 which includes a heater for heating the purge chamber, the wipe being heated by heat transfer from the purge chamber.

25. A maintenance system according to claim 1 adapted for an ink jet printer having a drum which rotates to carry print media past the ink jet print head during printing of the media, the maintenance system including a cam mounted to the drum, the purge chamber support including a cam follower positioned to engage the cam, the cam and cam follower comprising means for selectively engaging the ink jet nozzle orifice surface with the ink jet print head engaging surfaces.

26. In an ink jet printer of the type having an ink jet print head with an ink jet nozzle surface containing at least one orifice through which ink drops are ejected, the improvement comprising:

a print head drip edge projecting downwardly below the ink jet nozzle surface for collecting ink from the ink jet nozzle surface;

an ink drip collector having a downwardly inclined ink collection surface with an upper edge and a lower edge, the upper edge being spaced apart from and positioned below the print head drip edge to receive ink therefrom; and an ink receptacle positioned below the lower edge of the ink collection surface of the ink drip collector to receive ink.

27. In an ink printer according to claim 26, the print head drip edge including plural downwardly projecting ink drop concentration points.

28. In an ink jet printer according to claim 27, the ink jet print head drip edge being perforated.

29. In an ink jet printer of the type having an ink jet print head with an ink jet nozzle orifice surface containing at least one orifice through which ink drops are ejected, a method of cleaning or maintaining an ink jet print head, comprising the steps of:

(a) performing a purge cycle by selectively maintaining a relative vacuum at the ink jet nozzle orifice surface while jetting ink from the ink jet print head to purge the ink jet print head, and releasing the relative vacuum applied to the ink jet nozzle orifice surface to end the purge cycle;

(b) performing an air cleaning cycle by directing a narrow air stream across the ink jet nozzle orifice surface while it is exposed to an ambient pressure; and (c) wiping the ink jet nozzle orifice surface with a wipe surface.

30. An ink jet print head maintenance method according to claim 42 including the step of performing the steps (a), (b) and (c) in sequence followed by repeating the step (b).

31. A method according to claim 30, including the step of repeating the steps (a), (b), (c) and (b) in this sequence, printing a print and repeating this sequence.

32. A method according to claim 31 including the step of increasing the duration of the purge cycle of step (a) the second time this sequence is repeated.

33. A method according to claim 29 including the step of periodically performing the steps (c) and (b) after each occurrence of printing a predetermined number of prints.

34. A method of maintaining an ink jet print head comprising:

positioning a purge chamber against an ink jet nozzle orifice surface to form a closed interior about the ink jet nozzle orifice surface, the purge chamber including an ink receiving opening which communicates with the interior of the purge chamber a baffle extending substantially across the ink receiving opening;

drawing a vacuum in the purge chamber through a vacuum port;

ejecting ink through nozzle orifices in the nozzle orifice plate into the purge chamber to strike the baffle, intercepting the ink within the purge chamber and deflecting the ink away from the vacuum port.

* * * * *

UNITED STATES PATENT AND TRADEMARK OFFICE

CERTIFICATE OF CORRECTION

PATENT NO. : 5,184,147

DATED : February 2, 1993

INVENTOR(S) : Donald B. MacLane, Ted E. Deur, Jeffrey J. Anderson, Donald R. Titterington, James C. Oswald, Richard S. Meissner It is certified that error appears in the above-indentified patent and that said Letters Patent is hereby corrected as shown below:

Column 21,
Claim 30, line 2 - after "claim" change "42" to --29--.

Signed and Sealed this

Thirty-first Day of December, 1996

Bruce Lehman

*Attest:*

BRUCE LEHMAN

*Attesting Officer*

*Commissioner of Patents and Trademarks*